US006048682A

United States Patent [19]

Ohzeki et al.

[11] Patent Number: 6,048,682

[45] Date of Patent: Apr. 11, 2000

[54] SILVER HALIDE PHOTOGRAPHIC MATERIAL AND IMAGE-FORMING METHOD USING SAME MATERIAL

[75] Inventors: Katsuhisa Ohzeki; Takanori Hioki, both of Kanagawa, Japan

[73] Assignee: Fuji Photo Film Co., Ltd., Kanagawa, Japan

[21] Appl. No.: 09/301,122

[22] Filed: Apr. 28, 1999

[30] Foreign Application Priority Data

May 6, 1998 [JP] Japan ..... 10-123789
Feb. 26, 1999 [JP] Japan ..... 11-050994

[51] Int. Cl.[7] ..... G03C 1/035

[52] U.S. Cl. ..... 430/567; 430/569; 430/581

[58] Field of Search ..... 430/567, 569, 430/581

[56] References Cited

U.S. PATENT DOCUMENTS

| | | | |
|---|---|---|---|
| 5,176,991 | 1/1993 | Jones et al. | 430/567 |
| 5,221,602 | 6/1993 | Maskasky | 430/567 |
| 5,389,509 | 2/1995 | Maskasky | 430/567 |
| 5,667,949 | 9/1997 | Szajewski | 430/567 |
| 5,674,674 | 10/1997 | Edwards et al. | 430/567 |
| 5,750,325 | 5/1998 | Szajewski | 430/567 |

*Primary Examiner*—Hoa Van Le
*Attorney, Agent, or Firm*—Sughrue, Mion, Zinn Macpeak & Seas, PLLC

[57] ABSTRACT

A silver halide photographic material is disclosed, comprising a support having thereon at least one light-sensitive silver halide emulsion layer, wherein at least 80% of the entire projected area of the silver halide grains contained in said silver halide emulsion layer are occupied by tabular silver halide grains having an aspect ratio of 2 or more and main planes of {111} faces, said silver halide grains comprise at least 80 mol % of silver chloride, and said tabular silver halide grains are spectrally sensitized with the dye represented by formula (S);

(S)

wherein $Z_1$ and $Z_2$ each represents a sulfur atom, a selenium atom, an oxygen atom or a nitrogen atom; and $V_1$ and $V_2$ each represents a monovalent substituent, provided that $V_1$ and $V_2$ each does not represent an aromatic group and adjacent two or more groups represented by $V_1$ or $V_2$ are not bonded to each other to form a condensed ring; $I_1$ and $I_2$ each represents 0, 1, 2, 3 or 4; $L_1$, $L_2$ and $L_3$ each represents a methine group; $R_1$ and $R_2$ each represents an alkyl group; $n_1$ represents 0, 1 or 2; $m_1$ represents a number of 0 or more necessary to neutralize the charge of the molecule; and $M_1$ represents a charge balancing counter ion, and further an image-forming method is disclosed, which comprises imagewise exposing and development processing the above silver halide photographic material.

13 Claims, No Drawings

SILVER HALIDE PHOTOGRAPHIC MATERIAL AND IMAGE-FORMING METHOD USING SAME MATERIAL

FIELD OF THE INVENTION

The present invention relates to a silver halide photographic material for photography. In particular, the present invention relates to improvement of processing the silver halide photographic material comprising tabular silver chloride grains or grains having a high silver chloride content such as silver chlorobromide, silver chloroiodide or silver chloroiodobromide, having {111} faces.

BACKGROUND OF THE INVENTION

Various techniques for utilizing grains having a high silver chloride content, i.e., so-called high silver chloride grains (grains having a silver chloride content of 80% or more, hereinafter referred to as "high silver chloride grains"), have been proposed for the purpose of simple and rapid development processing. The use of high silver chloride grains brings about such advantages as developing speed is increased and reusability of a processing solution is heightened. Therefore, materials of the types in which high silver chloride grains are used have now become the mainstream of photosensitive materials for printing such as color photographic paper. In the present invention, processing time means the time from the initiation of processing (contact of a photographic material with a developing solution) to drying (Dry to Dry).

High silver chloride grains according to ordinary manufacturing conditions are liable to become grains having {100} outer faces (hereinafter referred to as {100} grains), and grains so far been used practically are also cubic grains. Tabular {100} grains having a large specific surface area (the ratio of a surface area to a volume) have been developed in recent years, which have various advantages such as spectral sensitization can be performed effectively, and the covering power after development is large by virtue of the large specific surface area. Examples of such grains are disclosed in U.S. Pat. Nos. 5,320,938, 5,264,337 and 5,292,632.

However, as compared with conventionally used silver bromide grains, high silver chloride {100} grains have a problem such as grains are easily fogged. To cope with this problem, grains having a high silver chloride content and {111} faces as outer faces (hereinafter referred to as {111} grains), have been utilized. An example thereof is disclosed in JP-A-6-138619 (the term "JP-A" as used herein means an "unexamined published Japanese patent application").

Special contrivances are necessary to manufacture {111} grains having a high silver chloride content. Wey discloses in U.S. Pat. No. 4,399,215 a method of manufacturing high silver chloride tabular grains by using ammonia. The fact that ammonia is used in the grains manufactured according to this method means that silver chloride grains originally having high solubility is produced with higher solubility, therefore, practicable small size grains are difficult to be produced. Further, such grains have a disadvantage of fogging being liable to occur as the pH at manufacturing time is as high as from 8 to 10. Maskasky discloses in U.S. Pat. No. 5,061,617 high silver chloride {111} grains manufactured by the use of thiocyanate. Thiocyanate also increases the solubility of silver chloride so with ammonia. For forming high silver chloride grains having {111} outer faces without increasing the solubility, methods by the addition of additives (crystal phase controllers, i.e., crystal habit controllers) at the time of grain formation are known. Examples of such methods are listed below.

| Patent No. | Crystal Habit Controller | Inventor |
|---|---|---|
| U.S. Pat. No. 4,400,463 | Azaindenes plus thioether peptizer | Maskasky |
| U.S. Pat. No. 4,783,398 | 2,4-Dithiazolidinone | Mifune et al. |
| U.S. Pat. No. 4,713,323 | Aminopyrazolopyrimidine | Maskasky |
| U.S. Pat. No. 4,983,508 | Bispyridinium salt | Ishiguro et al. |
| U.S. Pat. No. 5,185,239 | Triaminopyrimidine | Maskasky |
| U.S. Pat. No. 5,178,997 | 7-Azaindole compound | Maskasky |
| U.S. Pat. No. 5,178,998 | Xanthine | Maskasky |
| JP-A-64-70741 | Dye | Nishikawa et al. |
| JP-A-3-212639 | Aminothioether | Ishiguro |
| JP-A-4-283742 | Thiourea derivative | Ishiguro |
| JP-A-4-335632 | Triazolium salt | Ishiguro |
| JP-A-2-32 | Bispyridinium salt | Ishiguro et al. |
| JP-A-8-227117 | Monopyridinium salt | Ozeki et al. |

Further, the tabular grains are preferred for the spectral sensitization since the tabular grains have a large surface area to a volume (i.e., specific surface area) and therefore can adsorb a large amount of sensitizing dyes. However, in use of the tabular grains, a large residual color is generated after processing, and thereby the residual color is observed as fog. Accordingly, the problem regarding generation of fog becomes more serious as compared with the regular grains.

On the other hand, the color developing time of 180 seconds has now become the mainstream in color printing materials. Further shortening of the processing time is desired, but when the processing time is shortened, the amount of the sensitizing dye used in the emulsion remained after development (residual color) is increased and the problem of the residual color is serious the more. Accordingly, techniques for reducing the fog attributable to residual colors have been demanded.

A technique for improving this problem as to high silver chloride {100} tabular grains is disclosed in U.S. Patent 5,674,674, but the technique for inhibiting the fog resulting from a residual color with respect to high silver chloride {111} tabular grains has also been desired.

SUMMARY OF THE INVENTION

An object of the present invention is to provide a method for forming an image of high quality capable of rapid development processing and generating less fog.

The above object of the present invention has been attained by the following means:

(1) A silver halide photographic material comprising a support having thereon at least one light-sensitive silver halide emulsion layer, wherein at least 80% of the entire projected area of the silver halide grains contained in said silver halide emulsion layer are occupied by tabular silver halide grains having an aspect ratio of 2 or more and main planes of {111} faces, said silver halide grains comprise at least 80 mol % of silver chloride, and said tabular silver halide grains are spectrally sensitized with the dye represented by formula (S);

(S)

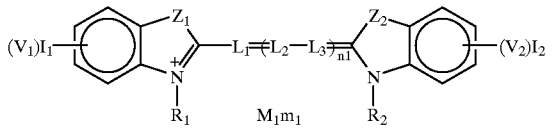

wherein $Z_1$ and $Z_2$ each represents a sulfur atom, a selenium atom, an oxygen atom or a nitrogen atom; and $V_1$ and $V_2$ each represents a monovalent substituent, provided that $V_1$ and $V_2$ each does not represent an aromatic group and adjacent two or more groups represented by $V_1$ or $V_2$ are not bonded to each other to form a condensed ring; $I_1$ and $I_2$ each represents 0, 1, 2, 3 or 4; $L_1$, $L_2$ and $L_3$ each represents a methine group; Re and $R_2$ each represents an alkyl group; $n_1$ represents 0, 1 or 2; $m_1$ represents a number of 0 or more necessary to neutralize the charge of the molecule; and $M_1$ represents a charge balancing counter ion.

The preferred embodiments of the present invention are shown below.

(2) The silver halide photographic material as claimed in the above item (1), said silver halide grains comprise the tabular grains containing at least 0.1 mol % of silver iodide based on all the silver amount in the total tabular grains and having the outermost layer containing 1 to 6 mol % of silver iodide.

(3) The silver halide photographic material as claimed in the above item (1), said tabular silver halide grains are formed in the presence of at least one compound selected from the compounds represented by formulae (I), (II) and (III);

(I)

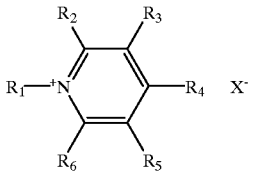

wherein $R_1$ represents an alkyl group, an alkenyl group, or an aralkyl group; $R_2$, $R_3$, $R_4$, $R_5$ and $R_6$ each represents a hydrogen atom or a substituent group, $R_2$ and $R_3$, $R_3$ and $R_4$, $R_4$ and $R_5$, and $R_5$ and $R_6$ may be condensed to form a ring, provided that at least one of $R_2$, $R_3$, $R_4$, $R_5$ and $R_6$ represents an aryl group; and $X^-$ represents a counter anion;

(II)

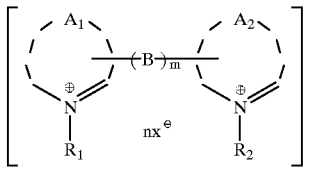

(III)

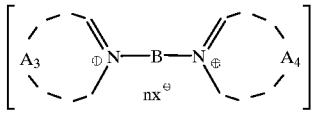

wherein $A_1$, $A_2$, $A_3$ and $A_4$, which may be the same or different, each represents a nonmetallic atomic group necessary for completing a nitrogen-containing heterocyclic ring; B represents a divalent linking group; m represents 0 or 1; $R_1$ and $R_2$ each represents an alkyl group; X represents an anion; and n represents 0 or 1, and n represents 0 when inner salt is formed.

(4) An image-forming method which comprises image-wise exposing and development processing a silver halide photographic material comprising a support having thereon at least one light-sensitive silver halide emulsion, wherein said silver halide photographic material is processed in a total processing time of 75 seconds or less, and said silver halide photographic material is a light-sensitive material, wherein at least 80% of the entire projected area of the silver halide grains contained in said silver halide emulsion layer are occupied by tabular silver halide grains having an aspect ratio of 2 or more and main planes of {111} faces, said silver halide grains comprise at least 80 mol % of silver chloride, and said tabular silver halide grains are spectrally sensitized with the dye represented by formula (S);

(S)

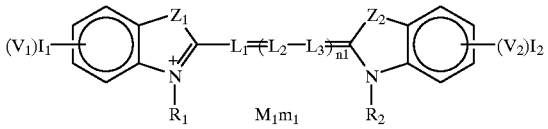

wherein $Z_1$ and $Z_2$ each represents a sulfur atom, a selenium atom, an oxygen atom or a nitrogen atom; and $V_1$ and $V_2$ each represents a monovalent substituent, provided that $V_1$ and $V_2$ each does not represent an aromatic group and adjacent two or more groups represented by $V_1$ or $V_2$ are not bonded to each other to form a condensed ring; $I_1$ and $I_2$ each represents 0, 1, 2, 3 or 4; $L_1$, $L_2$ and $L_3$ each represents a methine group; $R_1$ and $R_2$ each represents an alkyl group; $n_1$ represents 0, 1 or 2; ml represents a number of 0 or more necessary to neutralize the charge of the molecule; and $M_1$ represents a charge balancing counter ion.

(5) The image-forming method as claimed in the above item (4), which comprises digital scanning exposure.

DETAILED DESCRIPTION OF THE INVENTION

The silver halide grains for use in the present invention are described in detail below.

The high silver chloride grains for use in the present invention are grains having a silver chloride content of 80 mol % or more, more preferably 95 mol % or more.

The grain for use in the present invention consists of a core part and a shell part (the outermost layer) where a more amount of iodide is contained than in the core part. The core part preferably comprises 90% or more of silver chloride. The core part may comprise two or more parts having different halogen compositions. The volume of the shell part is preferably 50% or less, particularly preferably 20% or less, of the entire grain volume.

The silver iodide content in the shell part is preferably from 0.5 to 13 mol %, particularly preferably from 1 to 6 mol %. The silver iodide content in all the grain is preferably 0.1 mol % or more, more preferably from 0.1 to 5 mol %, particularly preferably from 0.1 to 2 mol %.

The silver iodide content in the core part is preferably 1 mol % or less, particularly preferably 0 mol %.

The silver bromide content may be different between the core part and the shell part.

The silver bromide content is preferably from 0 to 20 mol %, particularly preferably from 0 to 5 mol % based on the entire grain.

The silver halide grains according to the present invention are tabular grains having {111} faces as main planes.

The diameter of the silver halide tabular grains according to the present invention is preferably from 0.2 to 1.0 μm. The diameter of the silver halide grains used here means the diameter (i.e., the equivalent-circle diameter) of a circle having the same area as the projected area of a grain in the electron microphotograph. The thickness of the tabular grains according to the present invention is 0.2 μm or less, preferably 0.15 μm or less, and particularly preferably 0.1 μm or less. The diameter/thickness ratio (i.e., the aspect ratio) is 2 or more, preferably from 3 to 20.

Also, the average aspect ratio (i.e., the average diameter/thickness ratio) in the entire tabular grains having the aspect ratio of 2 or more is preferably from 3 to 20, particularly preferably from 5 to 15.

Tabular grains are in general tabular and have two parallel planes, accordingly "the thickness" of a tabular grain in the present invention means the distance between two parallel main planes constituting the tabular grain.

The silver halide grains according to the present invention may be polydispersed or monodispersed but are preferably monodispersed.

The dispersion coefficient of the equivalent-circle diameter of the silver halide grains is preferably from 5 to 25%, particularly preferably from 5 to 20%. The dispersion coefficient of the thickness is preferably from 5 to 25%, particularly preferably from 5 to 15.

A tabular grain-forming method is described below.

In the high silver chloride grains of the present invention, a crystal phase controller (i.e., a crystal habit controller) is used for forming {111} faces in the outermost layer as described above. The tabular grains according to the present invention can be obtained by forming two parallel twin planes. As the formation of twin planes is influenced by the temperature, the dispersion medium (gelatin), the halogen concentration, etc., appropriate conditions of them must be set up. When the crystal phase controller (i.e., the crystal habit controller) is present at the time of nucleation, the concentration of the gelatin is preferably from 0.1% to 10%, and the concentration of the chloride is 0.01 mol/liter or more, preferably 0.03 mol/liter or more.

Further, it is disclosed in JP-A-8-184931 that when monodispersed grains are desired, a crystal phase controller (i.e., a crystal habit controller) is preferably not used at the time of nucleation. When a crystal phase controller is not used at nucleation, the gelatin concentration is from 0.03 to 10%, preferably from 0.05 to 1.0%, and the chloride concentration is from 0.001 mol/liter to 1 mol/liter, preferably from 0.003 mol/liter to 0.1 mol/liter. The nucleation temperature can be selected arbitrarily between 2° C. and 90° C., but is preferably from 5° C. to 80° C., particularly preferably from 5° C. to 40° C.

The nuclei of tabular grains are formed at the first nucleation stage but many nuclei other than nuclei of tabular grains are contained in the reaction vessel immediately after nucleation. Therefore, the technique of growing only tabular grains and vanishing other grains after nucleation and ripening processes becomes necessary. When ordinary Ostwald ripening is conducted, tabular grain nuclei are also dissolved and vanished, tabular grain nuclei are reduced, as a result, the sizes of the tabular grains obtained come out increased. A crystal phase controller is added to prevent such a situation. In particular, the effect of the crystal phase controller can be heightened by the use of phthalated gelatin in combination, and the dissolution of tabular grains can be inhibited. The pAg during ripening is particularly important, and it is preferably from 60 to 130 mV to the silver-silver chloride electrode.

Subsequently, the nuclei formed are grown by physical ripening and the addition of a silver salt and a halide in the presence of a crystal phase controller. The chloride concentration at this time is 5 mol/liter or less, preferably from 0.05 to 1 mol/liter. The temperature during grain growth can be selected between 10° C. and 90° C., but is preferably from 30° to 80° C.

The total use amount of the crystal phase controller is $6\times10^{-5}$ mol or more, particularly preferably from $3\times10^{-4}$ to $6\times10^{-2}$ mol, per mol of the silver halide in the finished emulsion. The crystal phase controller can be added at any time from the nucleation to physical ripening and during grain growth of the silver halide grains. The formation of {111} faces begins after the addition. The crystal phase controller may be previously added to the reaction vessel but when small size tabular grains are to be formed, the crystal phase controller is preferably added to the reaction vessel with the growth of the grains and the concentration is gradually increased.

If the dispersion medium used at the nucleation is short for the grain growth, it should be supplied by the addition. For the growth, gelatin is preferably present in the amount of 10 to 100 g/liter. The gelatin to be supplied is preferably phthalated gelatin or trimellite gelatin.

The pH at grain formation is arbitrary but the range of from neutral to acidic is preferred.

If the crystal phase controller is present on the surfaces of the grains after grain formation, it influences the adsorption of sensitizing dyes and development, therefore, it is preferred to remove the controller after the grain formation. However, when the crystal phase controller is removed, it is difficult to maintain {111} faces of the high silver chloride grains under ordinary conditions. Accordingly, it is preferred to maintain the grain shape by substituting with photographically useful compounds such as a sensitizing dye, etc. Such methods are disclosed in JP-A-9-80656, JP-A-9-106026, U.S. Pat. Nos. 5,221,602, 5,286,452, 5,298,387, 5,298,388 and 5,176,992.

The crystal phase controller is desorbed from the grains as described above and it is preferred to remove the crystal phase controller desorbed out of the emulsion by washing with water. Washing can be effected at temperature not coagulating gelatin which is usually used as protective colloid. Various well-known washing methods can be used such as a flocculation method or an ultrafiltration method. When a pyridinium salt is used as a crystal phase controller, the washing temperature is preferably 40° C. or more, particularly preferably 50° C. or more. Further, when a flocculation method is used for washing, it is necessary to use a precipitant. Precipitants are classified into two types, i.e., those having a sulfonic acid group and those having a carboxylic acid group. As a pyridinium salt crystal phase controller has a strong interaction with a sulfonic acid group and forms a salt with the precipitant even if desorbed from the grains, removal by the washing process is difficult. Accordingly, a precipitant having a carboxylic acid group is preferably used. Examples of the precipitants having a carboxylic acid are disclosed in British Patent 648,472.

In addition, the desorption of a crystal phase controller from the grains is accelerated at low pH. Therefore, the pH in the washing process is preferably as low as possible unless the grains do not agglomerate excessively.

In the present invention, high silver chloride {111} tabular grains are formed in the presence of the compound represented by formula (I), (II) or (III) as the crystal phase controller.

The compound represented by formula (I) for use in the present invention is described in detail below.

In formula (I), $R_1$ preferably represents a straight chain, branched or cyclic alkyl group having from 1 to 20 carbon atoms (e.g., methyl, ethyl, isopropyl, t-butyl, n-octyl, n-decyl, n-hexadecyl, cyclopropyl, cyclopentyl, cyclohexyl), an alkenyl group having from 2 to 20 carbon atoms (e.g., allyl, 2-butenyl, 3-pentenyl), or an aralkyl group having from 7 to 20 carbon atoms (e.g., benzyl, phenethyl). Each group represented by R, may be substituted. As the substituents for $R_1$, substitutable groups represented by $R_2$ to $R_6$ described below can be exemplified.

$R_2$, $R_3$, $R_4$, $R_5$ and $R_6$, which may be the same or different, each represents a hydrogen atom or a substitutable group. Examples of the substitutable groups include a halogen atom, an alkyl group, an alkenyl group, an alkynyl group, an aralkyl group, an aryl group, a heterocyclic group (e.g., pyridyl, furyl, imidazolyl, piperidyl, morpholino), an alkoxyl group, an aryloxy group, an amino group, an acylamino group, a ureido group, a urethane group, a sulfonylamino group, a sulfamoyl group, a carbamoyl group, a sulfonyl group, a sulfinyl group, an alkyloxycarbonyl group, an acyl group, an acyloxy group, a phosphoric acid amido group, an alkylthio group, an arylthio group, a cyano group, a sulfo group, a carboxyl group, a hydroxyl group, a phosphono group, a nitro group, a sulfino group, an ammonio group (e.g., trimethylammonio), a phosphonio group, and a hydrazino group. These groups may further be substituted.

$R_2$ and $R_3$, $R_3$ and $R_4$, $R_4$ and $R_5$, and $R_5$ and $R_6$ may be condensed to form a quinoline ring, an isoquinoline ring, or an acridine ring.

$X^-$ represents a counter anion. Examples of counter anions include, e.g., a halogen ion (chlorine, bromine), a nitrate ion, a sulfate ion, a p-toluenesulfonate ion, a trifluoromethanesulfonate ion, etc.

In formula (I), preferably RI represents an aralkyl group, and at least one of $R_2$, $R_3$, $R_4$, $R_5$ and R, represents an aryl group.

In formula (I), more preferably $R_1$ represents an aralkyl group, $R_4$ represents an aryl group, and $X^-$ represents a halogen ion. Examples of such compounds are disclosed as Crystal Habit Controllers (i.e., crystal phase controllers) 1 to 29 in European Patent Application No. 723187A, but the present invention is not limited thereto.

The compounds represented by formulae (II) and (III) for use in the present invention are described in detail below.

$A_1$, $A_2$, $A_3$ and $A_4$ each represents a nonmetallic element group necessary for completing a nitrogen-containing heterocyclic ring, in which an oxygen atom, a nitrogen atom, or a sulfur atom may be contained, and benzene rings may be condensed. The heterocyclic rings formed by $A_1$, $A_2$, $A_3$ and $A_4$ may have substituents, which may be the same or different. Examples of the substituents include an alkyl group, an aryl group, an aralkyl group, an alkenyl group, a halogen atom, an acyl group, an alkoxycarbonyl group, an aryloxycarbonyl group, a sulfo group, a carboxyl group, a hydroxyl group, an alkoxyl group, an aryloxy group, an amido group, a sulfamoyl group, a carbamoyl group, a ureido group, an amino group, a sulfonyl group, a cyano group, a nitro group, a mercapto group, an alkylthio group, and an arylthio group. As preferred examples of $A_1$, $A_2$, $A_3$ and $A_4$, 5- or 6-membered rings (e.g., a pyridine ring, an imidazole ring, a thiazole ring, an oxazole ring, a pyrazine ring, a pyrimidine ring) can be exemplified, and a more preferred example is a pyridine ring.

B represents a divalent linking group. Divalent linking group is a linking group consisting of alkylene, arylene, alkenylene, —$SO_2$—, —SO—, —O—, —S—, —CO—, or —N($R'_2$)— (wherein $R'_2$ represents an alkyl group, an aryl group or a hydrogen atom), alone or in combination. Preferred examples of B include alkylene and alkenylene. m represents 0 or 1.

$R_1$ and $R_2$ each represents an alkyl group having from 1 to 20 carbon atoms, and $R_1$ and $R_2$ may be the same or different.

The alkyl group means a substituted or unsubstituted alkyl group, and examples of the substituents are the same as those exemplified as the substituents of $A_1$, $A_2$, $A_3$ and $A_4$.

$R_1$ and $R_2$ each preferably represents an alkyl group having from 4 to 10 carbon atoms, and more preferably a substituted or unsubstituted aryl-substituted alkyl group.

X represents an anion, e.g., a chlorine ion, a bromine ion, an iodine ion, a nitrate ion, a sulfate ion, a p-toluenesulfonate ion and an oxalate ion. n represents 0 or 1, and n represents 0 when inner salt is formed.

Specific examples of the compounds represented by formula (II) or (III) are disclosed as Compounds 1 to 42 in U.S. Pat. No. 4,983,508, but the present invention is not limited thereto.

The spectral sensitizing dye of the present invention represented by formula (S) is described in detail below.

In formula (S), $Z_1$ and $Z_2$ each represents a sulfur atom, a selenium atom, an oxygen atom or a nitrogen atom. Preferably at least either one of $Z_1$ and $Z_2$ represents a sulfur atom.

$V_1$ and $V_2$ each represents a monovalent substituent, provided that $V_1$ and $V_2$ each does not represent an aromatic group or adjacent two or more groups represented by $V_1$ or $V_2$ are not bonded to each other to form a condensed ring; $I_1$ and $I_2$ each represents 0, 1, 2, 3 or 4; $R_1$ and $R_2$ each represents an alkyl group; $L_1$, $L_2$ and $L_3$ each represents a methine group; $n_1$ represents 0, 1 or 2; $M_1$ represents a charge balancing counter ion; and $m_1$ represents a number of 0 or more necessary to neutralize the charge of the molecule.

In formula (S), when $n_1$ represents 0, at least either one of $Z_1$ and $Z_2$ represents a sulfur atom.

In formula (S), when $n_1$ represents 0, $Z_1$ and $Z_2$ both represent a sulfur atom.

In formula (S), when $n_1$ represents 1, at least either one of $Z_1$ and $Z_2$ represents an oxygen atom.

In formula (S), when $n_1$ represents 1, $Z_1$ and $Z_2$ both represent an oxygen atom.

In formula (S), when n, represents 2, $Z_1$ and $Z_2$ both represent a sulfur atom.

The compounds represented by formula (S) for use in the present invention are described in detail below.

$Z_1$ and $Z_2$ each represents a sulfur atom, a selenium atom, an oxygen atom or a nitrogen atom. When $n_1$ represents 0, preferably at least either one of $Z_1$ and $Z_2$ represents a sulfur atom, more preferably $Z_1$ and $Z_2$ both represent a sulfur atom. When $n_1$ represents 1, preferably at least either one of $Z_1$ and $Z_2$ represents an oxygen atom, more preferably $Z_1$ and $Z_2$ both represent an oxygen atom. When n, represents 2, preferably $Z_1$ and $Z_2$ both represent a sulfur atom.

When $Z_1$ and $Z_2$ both represent a nitrogen atom, any monovalent substituent can be used as the substituents of the nitrogen atom, but an alkyl group, an aryl group, or a heterocyclic group is preferred, e.g., a substituted or unsubstituted alkyl group having from 1 to 15, preferably from 1 to 10, more preferably from 1 to 5, carbon atoms (e.g., methyl, ethyl, 2-carboxyethyl, 2,2,3,3,3-pentafluoropropyl, 2-fluoroethyl), a substituted or unsubstituted aryl group having from 6 to 20, preferably from 6 to 15, and more preferably from 6 to 10, carbon atoms (e.g., phenyl, o-carboxyphenyl), and a substituted or unsubstituted heterocyclic group having from 3 to 20, preferably from 4 to 15, and more preferably from 6 to 10, carbon atoms (e.g., 2-pyridyl, 2-thiazolyl) can be exemplified as examples of the substituents.

$V_1$ and $V_2$ each may represent any monovalent substituent, provided that $V_1$ and $V_2$ each does not represent an aromatic group and adjacent two or more groups represented by $V_1$ or $V_2$ are not bonded to each other to form a condensed ring. Assuming that the monovalent substituents are V, examples of V include, for example, a halogen atom (e.g., chlorine, bromine, iodine, fluorine), a mercapto group, a cyano group, a carboxyl group, a phosphoric acid group, a sulfo group, a hydroxyl group, a carbamoyl group having from 1 to 10, preferably from 2 to 8, and more preferably from 2 to 5, carbon atoms (e.g., methylcarbamoyl, ethylcarbamoyl, morpholinocarbonyl), a sulfamoyl having from 0 to 10, preferably from 2 to 8, and more preferably from 2 to 5, carbon atoms (e.g., methylsulfamoyl, ethylsulfamoyl), a nitro group, an alkoxyl group having from 1 to 20, preferably from 1 to 10, and more preferably from 1 to 8, carbon atoms (e.g., methoxy, ethoxy, 2-methoxyethoxy, 2-phenylethoxy), an acyl group having from 1 to 20, preferably from 2 to 12, and more preferably from 2 to 8, carbon atoms (e.g., acetyl, benzoyl, trichloroacetyl), an acyloxy group having from 1 to 20, preferably from 2 to 12, and more preferably from 2 to 8, carbon atoms (e.g., acetyloxy), an acylamino group having from 1 to 20, preferably from 2 to 12, and more preferably from 2 to 8, carbon atoms (e.g., acetylamino), a sulfonyl group having from 1 to 20, preferably from 1 to 10, and more preferably from 1 to 8, carbon atoms (e.g., methanesulfonyl, ethanesulfonyl, benzenesulfonyl), a sulfinyl group having from 1 to 20, preferably from 1 to 10, and more preferably from 1 to 8, carbon atoms (e.g., methanesulfinyl, benzenesulfinyl), a sulfonylamino group having from 1 to 20, preferably from 1 to 10, and more preferably from 1 to 8, carbon atoms (e.g., methanesulfonylamino, ethanesulfonylamino), an amino group, a substituted amino group having from 1 to 20, preferably from 1 to 12, and more preferably from 1 to 8, carbon atoms (e.g., methylamino, dimethylamino, benzylamino, anilino), an ammonium group having from 0 to 15, preferably from 3 to 10, and more preferably from 3 to 6, carbon atoms (e.g., trimethylammonium, triethylammonium), a hydrazino group having from 0 to 15, preferably from 1 to 10, and more preferably from 1 to 6, carbon atoms (e.g., trimethylhydrazino), a ureido group having from 1 to 15, preferably from 1 to 10, and more preferably from 1 to 6, carbon atoms (e.g., ureido, N,N-dimethylureido), an imido group having from 1 to 15, preferably from 1 to 10, and more preferably from 1 to 6, carbon atoms (e.g., succinimido), an alkyl- or arylthio group having from 1 to 20, preferably from 1 to 12, and more preferably from 1 to 8, carbon atoms (e.g., methylthio, ethylthio, carboxyethylthio, sulfobutylthio), an alkoxycarbonyl group having from 2 to 20, preferably from 2 to 12, and more preferably from 2 to 8, carbon atoms (e.g., methoxycarbonyl, ethoxycarbonyl), an unsubstituted alkyl group having from 1 to 18, preferably from 1 to 10, and more preferably from 1 to 5, carbon atoms (e.g., methyl, ethyl, propyl, butyl), a substituted alkyl group having from 1 to 18, preferably from 1 to 10, and more preferably from 1 to 5, carbon atoms (e.g., hydroxymethyl, trifluoromethyl, benzyl, carboxyethyl, ethoxycarbonylmethyl, acetylaminomethyl; here an unsaturated hydrocarbon group preferably having from 2 to 18, more preferably from 3 to 10, and particularly preferably from 3 to 5, carbon atoms (e.g., vinyl, ethynyl, 1-cyclohexenyl) is also included in the substituted alkyl group), and a heterocyclic group having from 1 to 20, preferably from 2 to 10, and more preferably from 4 to 6, carbon atoms which may be substituted (e.g., pyridyl, 5-methylpyridyl, thienyl, furyl, morpholino, tetrahydrofurfuryl). These substituents may further be substituted with V.

$V_1$ and $V_2$ each preferably represents an alkyl group, an alkoxyl group, a halogen atom, an acyl group, or a cyano group, more preferably an alkyl group, an alkoxyl group, or a halogen atom, particularly preferably a methyl group, a methoxy group, a fluorine atom, a chlorine atom, a bromine atom or an iodine atom, and most preferably a fluorine atom or a chlorine atom.

$I_1$ and $I_2$ each represents 0, 1, 2, 3 or 4, preferably 0, 1 or 2, more preferably 1 or 2, and particularly preferably 1. When I, and I2 each represents 2 or more, $V_1$ and $V_2$ are repeated but they need not be the same.

$M_1$ is included in the formula to show the presence of a cation or an anion when a counter ion is necessary for neutralizing an ionic charge of the dye. Representative examples of cations include an inorganic cation such as a hydrogen ion ($H^+$), an alkali metal ion (e.g., sodium ion, potassium ion, lithium ion), and an alkaline earth metal ion (e.g., calcium ion), and an organic cation such as an ammonium ion (e.g., ammonium ion, tetraalkylammonium ion, pyridinium ion, ethylpyridinium ion). Anions may be either inorganic or organic, and examples of the anions include a halogen anion (e.g., fluorine ion, chlorine ion, iodine ion), a substituted arylsulfonate ion (e.g., p-toluenesulfonate ion, p-chlorobenzenesulfonate ion), an aryldisulfonate ion (e.g., 1,3-benzenedisulfonate ion, 1,5-naphthalenedisulfonate ion, 2,6-naphthalenedisulfonate ion), an alkylsulfate ion (e.g., methylsulfate ion), a sulfate ion, a thiocyanate ion, a perchlorate ion, a tetrafluoroborate ion, a picrate ion, an acetate ion, and a trifluoromethanesulfonate ion. In addition, ionic polymers or other dyes having a counter charge to the dye may be used. Further, $CO_2^-$ and $SO_3^-$ can be described as $CO_2H$ and $SO_3H$ when they have a hydrogen ion as a counter ion.

$m_1$ represents a number necessary to balance a charge in the molecule and it represents 0 when an inner salt is formed. $m_1$ preferably represents from 0 to 10, more preferably from 0 to 4, and particularly preferably 0 or 1.

$R_1$ and $R_2$ each represents an alkyl group, for example, an unsubstituted alkyl group having from 1 to 18, preferably from 1 to 7, and particularly preferably from 1 to 4, carbon atoms (e.g., methyl, ethyl, propyl, isopropyl, butyl, isobutyl, hexyl, octyl, dodecyl, octadecyl), or a substituted alkyl group having from 1 to 18, preferably from 1 to 7, and particularly preferably from 1 to 4, carbon atoms [e.g., a heterocyclic group substituted with $V_1$, which is described above as a substituent of $Z_1$, etc., can be exemplified, preferably an aralkyl group (e.g., benzyl, 2-phenylethyl), an unsaturated hydrocarbon group (e.g., allyl), a hydroxyalkyl group (e.g., 2-hydroxyethyl, 3-hydroxypropyl), a carboxyalkyl group (e.g., 2-carboxyethyl, 3-carboxypropyl, 4-carboxybutyl, carboxymethyl), an alkoxyalkyl group (e.g., 2-methoxyethyl, 2-(2-methoxyethoxy)ethyl), an acyloxyalkyl group (e.g., 2-acetyloxyethyl), an acylalkyl group (e.g., 2-acetylethyl), a carbamoylalkyl group (e.g., 2-morpholinocarbonylethyl), a sulfamoylalkyl group (e.g., N,N-dimethylcarbamoylmethyl), a sulfoalkyl group (e.g., 2-sulfoethyl, 3-sulfopropyl, 3-sulfobutyl, 4-sulfobutyl, 2-(3-sulfopropoxy)ethyl, 2-hydroxy-3-sulfopropyl, 3-sulfopropoxyethoxyethyl), a sulfoalkenyl group, a sulfatoalkyl group (e.g., 2-sulfatoethyl, 3-sulfatopropyl, 4-sulfatobutyl), a heterocyclic group-substituted alkyl group (e.g., 2-(pyrrolidin-2-one-1-yl)ethyl, tetrahydrofurfuryl), or an alkylsulfonylcarbamoylmethyl group (e.g., methanesulfonylcarbamoylmethyl)] are exemplified.

Preferred alkyl groups represented by $R_1$ and $R_2$ are the above-described carboxyalkyl group, sulfoalkyl group, and unsubstituted alkyl group. Particularly preferred alkyl group is sulfoalkyl group.

$L_1$, $L_2$ and $L_3$ each represents a methine group. The methine groups represented by $L_1$, $L_2$ and $L_3$ may have a substituent, and examples of such substituents include a substituted or unsubstituted alkyl group having from 1 to 15, preferably from 1 to 10, and more preferably from 1 to 5, carbon atoms (e.g., methyl, ethyl, 2-carboxyethyl), a substituted or unsubstituted heterocyclic group having from 3 to 20, preferably from 4 to 15, and more preferably from 6 to 10, carbon atoms (e.g., N,N-diethylbarbituric acid), a halogen atom (e.g., chlorine, bromine, fluorine, iodine), an alkoxyl group having from 1 to 15, preferably from 1 to 10, and more preferably from 1 to 5, carbon atoms (e.g., methoxy, ethoxy), an alkylthio group having from 1 to 15, preferably from 1 to 10, and more preferably from 1 to 5, carbon atoms (e.g., methylthio, ethylthio), and an amino group having from 0 to 15, preferably from 2 to 10, and more preferably from 4 to 10, carbon atoms (e.g., N-methylpiperazino), and each may form a ring together with $R_1$ and $R_2$. $L_1$, $L_2$ and $L_3$ each preferably represents an unsubstituted methine group.

When $n_1$ is 0, $L_1$ preferably represents an unsubstituted methine group.

When $n_1$ is 1, $L_1$ and $L_3$ each preferably represent an unsubstituted methine group, and $L_2$ preferably represents a methine group substituted with unsubstituted alkyl group having from 1 to 4 carbon atoms, more preferably a methine group substituted with an ethyl group.

When $n_1$ is 2, a methine group is pentamethine cyanine, preferably methine chain is crosslinked.

When $n_1$ is 2, $L_2$ and $L_3$ are repeated but they need not be the same.

Specific examples of the compounds represented by formula (S) according to the present invention are shown below but the present invention is not limited thereto.

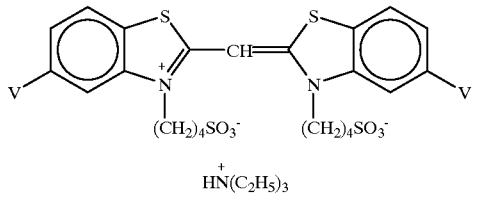

| No. | V |
|---|---|
| (1) | Cl |
| (2) | Br |
| (3) | I |
| (4) | F |
| (5) | H |
| (6) | $CH_3$ |
| (7) | $OCH_3$ |
| (8) | $CO_2H$ |
| (9) | $CO_2C_2H_5$ |

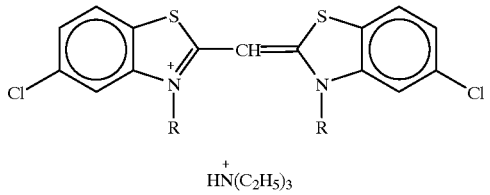

| No. | R |
|---|---|
| (10) | $(CH_2)_3SO_3^-$ |
| (11) | $(CH_2)_2CH(CH_3)SO_3^-$ |
| (12) | $CH_2CO_2^-$ |
| (13) | $(CH_2)_2SO_3^-$ |
| (14) | $(CH_2)_2CO_2^-$ |
| (15) | $(CH_2)_3OSO_3^-$ |
| (16) | $(CH_2)_2OSO_3^-$ |
| (17) | $(CH_2)_3PO_3^-$ |

(18)

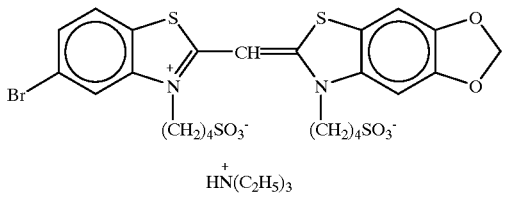

(19)

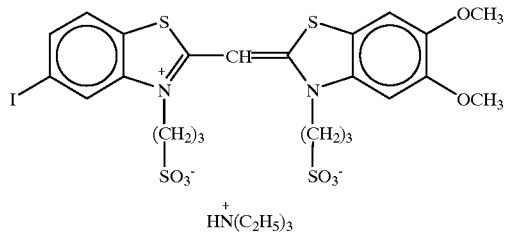

(20)

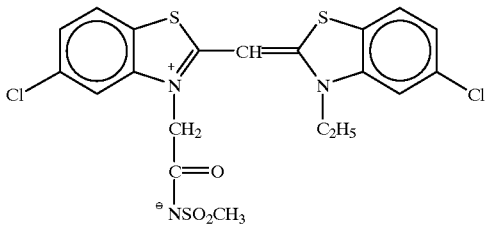

-continued
(21)
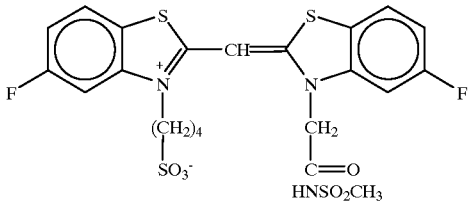
(22)
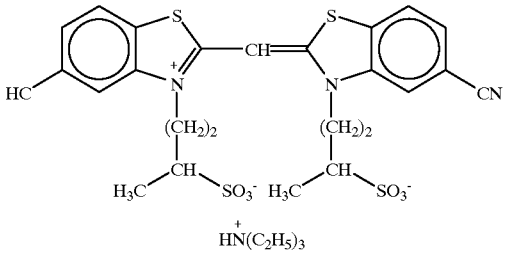
(23)
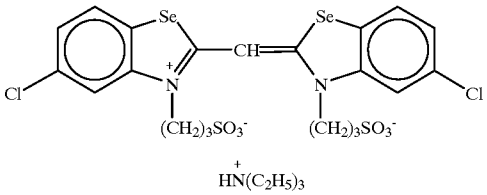
(24)
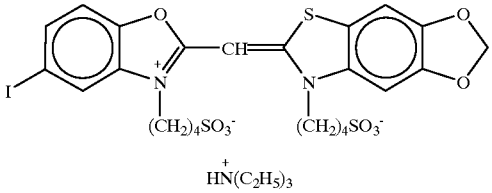
(25)
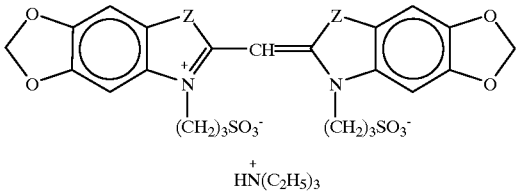
(25) Z=S
(26) Z=O
(27)
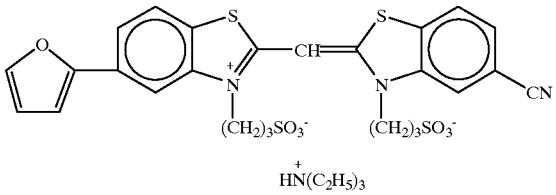
-continued
(28)
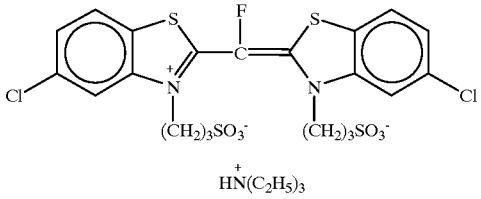
(29)
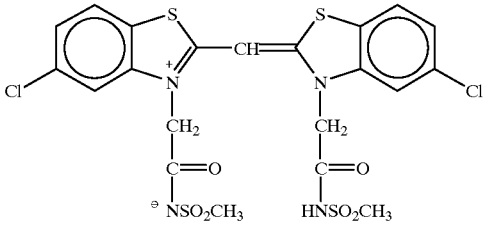
(30)
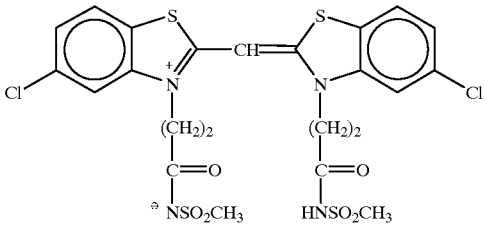
(31)
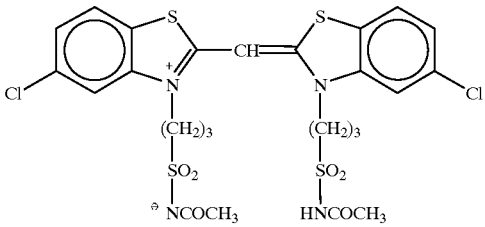
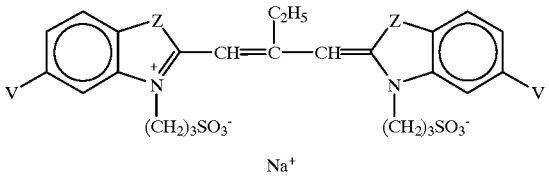
| No. | Z | V |
|---|---|---|
| (32) | O | Cl |
| (33) | O | F |
| (34) | O | H |
| (35) | O | Br |
| (36) | O | I |
| (37) | O | $COCH_3$ |
| (38) | O | $CH_3$ |
| (39) | O | $OCH_3$ |
| (40) | S | Cl |
| (41) | S | Br |
| (42) | S | I |
| (43) | S | F |
| (44) | S | H |
| (45) | S | CN |
| (46) | O | 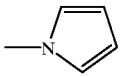 |

-continued

| | | |
|---|---|---|
| (47) | O | 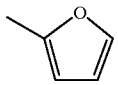 |
| (48) | S | 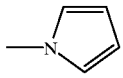 |
| (49) | S | 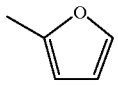 |
| (50) | Se | Cl |

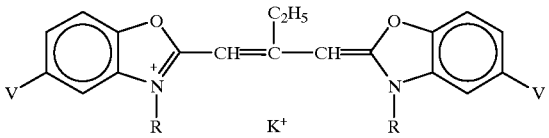

| No. | V | R |
|---|---|---|
| (51) | Br | $(CH_2)_4SO_3^-$ |
| (52) | " | $CH_2CO_2^-$ |
| (53) | Cl | $CH_2CO_2^-$ |
| (54) | " | $(CH_2)_4SO_3^-$ |

(55)

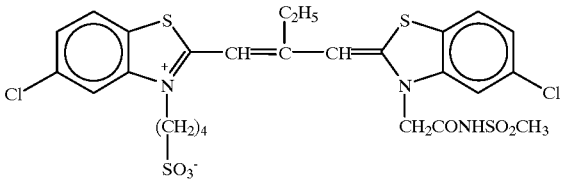

(56)

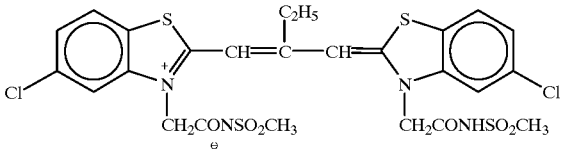

(57)

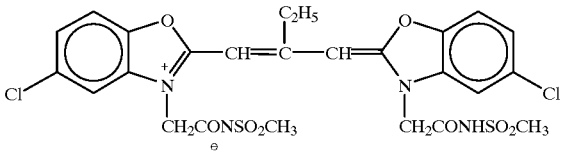

(58)

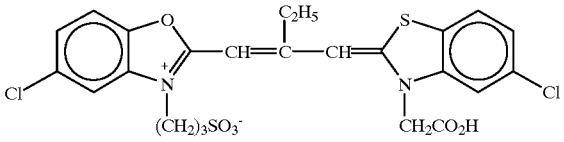

-continued

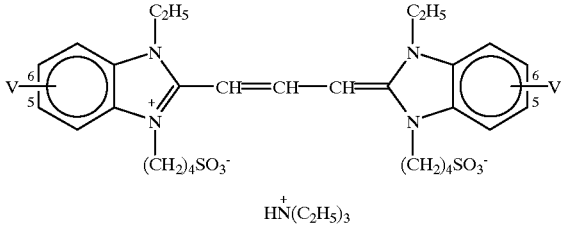

| No. | V |
|---|---|
| (59) | 5,6-$Cl_2$ |
| (60) | 5-CN, 6-Cl |
| (61) | 5-$CF_3$ |
| (62) | 5-CN |

(63)

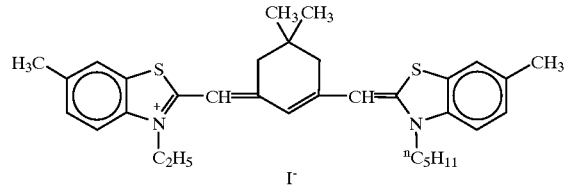

(64)

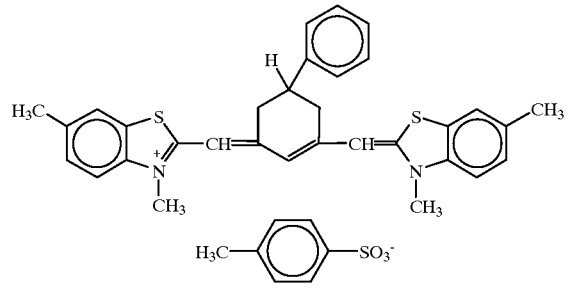

The compound represented by formula (S) of the present invention can be synthesized according to the methods described in F. M. Harmer, *Heterocyclic Compounds—Cyanine Dyes and Related Compounds*, John Wiley & Sons, New York, London (1964), D. M. Sturmer, *Heterocyclic Compounds Special Topics in Heterocyclic Chemistry*, Chap. 18, Clause 14, pp. 482 to 515, John Wiley & Sons, New York, London (1977), and *Rodd's Chemistry of Carbon Compounds,* 2nd Ed., Vol. IV, Part B, Chap. 15, pp. 369 to 422, Elsevier Science Publishing Company Inc., New York (1977) and the like.

For the inclusion of the sensitizing dyes for use in the present invention in the silver halide emulsion, they may be directly dispersed in the emulsion, or they may be dissolved in water, a single or mixed solvent of methanol, ethanol, propanol, acetone, methyl cellosolve, 2,2,3,3-tetrafluoropropanol, 2,2,2-trifluoroethanol, 3-methoxy-1-propanol, 3-methoxy-1-butanol, 1-methoxy-2-propanol, acetonitrile, tetrahydrofuran, N,N-dimethylformamide, etc., and then added to the emulsion.

In addition, various methods can be used for incorporating dyes in the emulsion, for example, a method in which dyes are dissolved in a volatile organic solvent, the solution is dispersed in water or hydrophilic colloid and this dispersion is added to the emulsion as disclosed in U.S. Pat. No. 3,469,987, a method in which water-insoluble dyes are dispersed in a water-soluble solvent without being dissolved and this dispersion is added to the emulsion as disclosed in JP-B-46-24185 (the term "JP-B" as used herein means an "examined Japanese patent publication"), a method in which dyes are added to the emulsion as an aqueous solution or colloidal dispersion coexisting with a surfactant as disclosed in U.S. Pat. Nos. 3,822,135 and 4,006,026, a method in which dyes are directly dispersed in a hydrophilic colloid and the dispersion is added to the emulsion as disclosed in JP-A-53-102733 and JP-A-58-105141, or a method in which dyes are dissolved using a compound capable of red-shifting and the solution is added to the emulsion as disclosed in JP-A-51-74624 can be used.

Further, ultrasonic waves can be used for dissolution.

As a more preferred method for adding the dyes for use in the present invention to the silver halide of the present invention, when the dyes are dissolved in water or a hydrophilic colloid aqueous solution, or when the dyes have solubility of $1.5\times10^{-2}$ mol/liter or less at 25° C., a method in which the dyes are dispersed in water or hydrophilic colloid as fine particles of 1 $\mu$m or less and the dispersion is added to the silver halide can be used. Alternatively, a method of dissolving or dispersing the dyes in a water-soluble organic solvent or in an aqueous solution of a water-soluble organic solvent is also preferably used. In this case, the amount of the organic solvent is preferably 5 vol % or less of the volume of the silver halide emulsion to be prepared.

Further, when the dyes for use in the present invention have solubility of $1.5\times10^{-4}$ mol/liter or less at 25° C., a method of directly adding these cyanine dyes to the silver halide emulsion as finely pulverized solids as they are is also preferred.

The time of the addition of the sensitizing dyes for use in the present invention to the silver halide emulsion of the present invention may be at any stage of the preparation of the emulsion recognized as useful hitherto. For example, they may be added at any stage if it is before coating, i.e., before grain formation stage of silver halide grains or/and before desalting stage, during desalting stage and/or after desalting and before beginning of chemical ripening, as disclosed in U.S. Pat. Nos. 2,735,766, 3,628,960, 4,183,756, 4,225,666, JP-A-58-184142 and JP-A-60-196749, or immediately before or during chemical ripening, after chemical ripening and before coating as disclosed in JP-A-58-113920, but the time of the addition of the sensitizing dyes is preferably before desalting stage for the removal of the exchange-adsorbed crystal phase controller out of the system. Also, as disclosed in U.S. Pat. No. 4,225,666 and JP-A-58-7629, the sensitizing dyes can be used as a single compound alone or in combination with compounds having different structures, and they can be added in the same stage, or they can be divided and added separately, for example, one part of them is added during grain formation stage and the remaining is added during chemical ripening or after the completion of chemical ripening, otherwise one part is added prior to chemical ripening or during ripening stage and the remaining after completion of chemical ripening. The kinds of compounds added separately and combinations of compounds may be varied.

Further, a prescribed amount of the dyes may be added in a short period of time, or they may be added continuously over a long term during arbitrary processes, e.g., after the nucleation until the completion of the grain formation in the grain forming process, or over the chemical ripening process. The addition rate in such a case may be a constant (flow) rate, or the (flow) rate may be accelerated or reduced.

When sensitizing dyes are added to a silver halide emulsion, the temperature is not particularly restricted, but it is generally from 35° C. to 70° C. An addition temperature and a ripening temperature may be different. A method of adding dyes at 45° C. or less, increasing the temperature, and then performing ripening is more preferred.

The total addition amount of the dye for use in the present invention is varied according to the shapes and the sizes of silver halide grains, but the total addition amount is generally from $5.5\times10^{-6}$ to $1.2\times10^{-2}$ mol per mol of the silver halide. For example, when the grain size of the silver halide is from 0.2 to 2.0 $\mu$m, the addition amount is preferably from $4.0\times10^{-7}$ to $6.5\times10^{-6}$ mol, more preferably from $1.0\times10^{-6}$ to $4.2\times10^{-6}$ mol, per $m^2$ of the surface area of the silver halide grain.

Ions or complex ions of metals belonging to group VIII of the Periodic Table, such as osmium, iridium, rhodium, platinum, ruthenium, palladium, cobalt, nickel and iron, can be used in the silver halide grains according to the present invention alone or in combination. Further, these metals may be used in combination of two or more.

These above-described metal ion donating compounds can be included in silver halide grains according to the present invention by various means such as adding to an aqueous solution of gelatin as a dispersion medium, an aqueous solution of halide, an aqueous solution of silver salt, or other aqueous solutions, during silver halide grain formation, or adding to a silver halide emulsion in the form of silver halide fine grains having incorporated therein metal ions in advance and dissolving this emulsion. Metal ions can be incorporated to the grains at any time before grain formation, during grain formation, or immediately after grain formation. The time of addition can be varied according as where of the grain and how much amount of metal ions is to be incorporated.

In the silver halide grains of the present invention, it is preferred that 50 mol % or more, preferably 80 mol % or more, and more preferably 100%, of the metal ion donating compound used is distributed locally at the surface layer of from the silver halide grain surface to the place corresponding to 50% or less of the grain volume. The volume of the surface layer is preferably 30% or less. The local distribution of the metal ion on the surface layer is effective for inhibiting the increase of inner sensitivity to obtain high sensitivity. The metal ion donating compound can be incorporated convergently to the surface layer of the silver halide grain by supplying, after the silver halide grain except surface layer (the core part) has been formed, the metal ion donating compound concurrently with the addition of a water-soluble silver salt solution and a halide aqueous solution for forming the surface layer.

In addition to groups VIII metals, various polyvalent metal ion impurities can be introduced to the silver halide emulsion for use in the present invention during emulsion grain forming process or physical ripening process. The addition amounts of such compounds are various according to purposes but is preferably from $10^{-9}$ to $10^{-2}$ mol per mol of the silver halide.

The silver halide emulsion for use in the present invention is usually chemically sensitized. As chemical sensitization methods, there are a gold sensitization method using gold compounds (e.g., disclosed in U.S. Pat. Nos. 2,448,060, 3,320,069), a sensitization method using metals such as iridium, platinum, rhodium, palladium, etc. (e.g., disclosed in U.S. Pat. Nos. 2,448,060, 2,566,245, 2,566,263), a sulfur sensitization method using sulfur-containing compounds (e.g., disclosed in U.S. Pat. No. 2,222,264), a selenium sensitization method using selenium compounds, a tellurium sensitization method using tellurium compounds, and a reduction sensitization method using tin salts, thiourea dioxide, polyamine, etc. (e.g., disclosed in U.S. Pat. Nos. 2,487,850, 2,518,698, 2,521,925). These sensitization methods can be used alone or in combination.

The silver halide emulsion for use in the present invention is preferably an emulsion subjected to gold sensitization known in this industry. Fluctuations of photographic properties due to scanning exposure by laser beams etc. can be reduced by subjecting the emulsion to gold sensitization. Compounds such as chloroauric acid or salts thereof, gold thiocyanates or gold thiosulfates, etc., can be used for gold sensitization. The addition amounts of these compounds are varied depending on cases, but is usually from $5\times10^{-7}$ to $5\times10^{-2}$ mol, preferably from $1\times10^{-6}$ to $1\times10^{-3}$ mol, per mol of the silver halide. These compounds are added before completion of chemical sensitization.

In the present invention, gold sensitization is preferably conducted in combination with other sensitization methods such as sulfur sensitization, selenium sensitization, tellurium sensitization, reduction sensitization or noble metal sensitization using noble metals other than gold compounds.

The silver halide emulsion for use in the present invention can contain various compounds or precursors thereof for the purpose of preventing fog or stabilizing photographic properties during manufacture, storage or photographic processing of the photographic material. Specific examples of the compounds preferably used in the present invention are disclosed in JP-A-62-215272, pp. 39 to 72. The emulsion for use in the present invention is preferably a so-called surface latent image type emulsion in which the latent image is mainly formed on the surface of the grains.

A transmitting type support and a reflective type support can be used as a photographic support of the silver halide photographic material of the present invention, and a reflective type support is preferably used. In particular, a reflective type support, which is laminated with a plurality of polyethylene layers and polyester layers and at least one of such water resistant resin layers (laminate layers) contains a white pigment (e.g., titanium oxide) and/or a color pigment (e.g., ultramarine blue) is preferred.

Further, a brightening agent is preferably contained in the above water resistant resin layers. A brightening agent may be dispersed in a hydrophilic colloid layer of a photographic material. Preferred brightening agents are benzoxazole based, coumarin based, and pyrazoline based brightening agents, and more preferred are benzoxazolylnaphthalene based and benzoxazolylstilbene based brightening agents. The addition amount is not particularly limited but is preferably from 1 to 100 mg/m$^2$. The mixing ratio when they are added to a water resistant resin is preferably from 0.0005 to 3 wt %, more preferably from 0.001 to 0.5 wt %, based on the resin.

A cellulose triacetate film and a transparent film such as polyethylene terephthalate, a film of polyester of 2,6-naphthalenedicarboxylic acid (NDCA) and ethylene glycol (EG), polyester of NDCA, terephthalic acid and EG having an information recording layer such as a magnetic recording layer, and a reflective (type) support having provided thereon a hydrophilic colloid layer containing a white pigment or a color pigment as described above can preferably be used as a reflective (type) support.

For improving image sharpness, the dyes decolorable by photographic processing (above all, oxonol dyes) disclosed in EP-A-337490, pp. 27 to 76 can be added to hydrophilic colloid layers of the photographic material according to the present invention so as to obtain the optical reflection density of 0.50 or more at 680 nm of the photographic material.

In the present invention, a colored layer capable of decoloration by processing are used in place of or in combination with water-soluble dyes. A colored layer capable of decoloration by processing may be in contact with an emulsion layer directly or may be disposed to contact with an emulsion layer via an interlayer containing a processing color mixing preventive such as gelatin and hydroquinone. This colored layer is preferably provided under the emulsion layer (the support side) which is colored to the same primary color as being colored. It is possible to provide all colored layers corresponding to each primary color independently or to provide only a part of it by selecting optionally. Further, it is possible to provide a colored layer which is colored to correspond with a plurality of primary color regions. With respect to the optical reflection density of a colored layer, the optical density value at the wavelength of the highest optical density in the wavelength of the color of the light source which is used for scanning exposure is preferably from 0.2 to 3.0, more preferably from 0.5 to 2.5, and most preferably from 0.8 to 2.0.

The conventionally well-known methods can be applied to form a colored layer, for example, a method in which the dyes disclosed in JP-A-2-282244, from page 3, right upper column to page 8, or the dyes disclosed in JP-A-3-7931, from page 3, right upper column to page 11, left lower column, are incorporated into a hydrophilic colloid layer in the form of a solid fine particle dispersion, a method in which anionic dyes are mordanted to cationic polymers, a method in which dyes are adsorbed onto fine grains such as silver halide and fixed in the layer, or a method in which colloidal silver are used as disclosed in JP-A-1-239544. With respect to a method of dispersing fine particles of a dye in a solid state, e.g., a method in which a fine particle dye which is substantially water-insoluble at pH 6 or less but is substantially water-soluble at pH 8 or more is incorporated into the layer is disclosed in JP-A-2-308244, pp. 4 to 13. Methods for preparing colloidal silver as a light absorbing agent are disclosed in U.S. Pat. Nos. 2,688,601 and 3,459,563. Of these methods, a method of incorporating fine particle dyes and a method of using colloidal silver are preferred.

Gelatin is preferably used as a binder or a protective colloid which can be used in the photographic material of the present invention, but hydrophilic colloid other than gelatin can be used alone or in combination with gelatin. Low-calcium gelatin having a calcium content of 800 ppm or less, more preferably 200 ppm or less, is preferably used as such gelatin. The antibacterial agents disclosed in JP-A-63-271247 are preferably used for preventing generation of various kinds of fungi and bacteria which proliferate in a hydrophilic colloid layer and deteriorate images.

The exposed photographic material can be processed by ordinary color development processing, but the photographic material of the present invention is preferably subjected to blixing after color development for the purpose of rapid processing. In particular, the pH of the blixing solution is preferably 6.5 or less and more preferably 6 or less for the purpose of acceleration of desilvering and the like.

Preferred examples of silver halide emulsions and other substances (additives and the like), and photographic constitutional layers (arrangement of the layers and the like) for use in the present invention, and processing methods and additives for processing the photographic materials are disclosed in the patents shown in Tables 1 to 5 below and, in particular, those disclosed in EP-A-355660 (corresponding to JP-A-2-139544) are preferably used.

TABLE 1

| Photographic Constitutional Element | JP-A-62-215272 | JP-A-2-33144 | EP-A-355660 |
|---|---|---|---|
| Silver Halide Emulsion | p. 10, right upper column, l. 6 to p. 12, left lower column, l. 5<br>p. 12, right lower column, 4 line up from the bottom to p. 13, left upper column, l. 17 | p. 28, right upper column, l. 16 to p. 29, right lower column, l. 11<br>p. 30, ll. 2 to 5 | p. 45, l. 53 to p. 47, l. 3<br>p.47. ll. 20 to 22 |
| Silver Halide Solvent | p. 12, left lower column, ll. 6 to 14<br>p. 13, left upper column, 3 line up from the bottom to p. 18, left lower column, last line | — | — |
| Chemical Sensitizer | p. 12, left lower column, 3 line up from the bottom to right lower column, 5 line up from the bottom<br>p. 18, right lower column, l. 1 to p. 22, right upper column, 9 line up from the bottom | p. 29, right lower column, l. 12 to last line | p. 47, l. 4 to 9 |
| Spectral Sensitizer (spectral sensitizing method) | p. 22, right upper column, 8 line up from the bottom to p. 38, last line | p. 30, left upper column, ll. 1 to 13 | p. 47, ll. 10 to 15 |
| Emulsion Stabilizer | p. 39, left upper column, l. 1 to p. 72, right upper column, last line | p. 30, left upper column, l. 14 to right upper column, l. 1 | p. 47, ll. 16 to 19 |
| Development Accelerator | p. 72, left lower column, l. 1 to p. 91, right upper column, l. 3 | — | — |

TABLE 2

| Photographic Constitutional Element | JP-A-62-215272 | JP-A-2-33144 | EP-A-355660 |
|---|---|---|---|
| Color Coupler (cyan, magenta, and yellow couplers) | p. 91, right upper column, l. 4 to p. 121, left upper column, l. 6 | p. 3, right upper column, l. 14 to p. 18, left upper column, last line<br>p. 30, right upper column, l. 6 to p. 35, right lower column, l. 11 | p. 4, ll. 15 to 27<br>p. 5, l. 30 to p. 28, last line<br>p. 45; ll. 29 to 31<br>p. 47, l. 23 to p. 63 l. 50 |
| Color forming Intensifier | p. 121, left upper column, l. 7 to p. 125, right upper column, l. 1 | — | — |
| UV Absorber | p. 125, right upper column, l. 2 to p. 127, left lower column, last line | p. 37, right lower column, l. 14 to p. 38, left upper column, l. 11 | p. 65, ll. 22 to 31 |
| Discoloration Inhibitor (image stabilizer) | p. 127, right lower column, l. 1 to p. 137, left lower column, l. 8 | p. 36, right upper column, l. 12 to p. 37, left upper column, l. 19 | p. 4, l. 30 to p. 5, l. 23<br>p. 29, l. 1 to p. 45, l. 25<br>p. 45, ll. 33 to 40<br>p. 65, ll. 2 to 21 |
| High Boiling Point and/or Low Boiling Point Organic Solvents | p. 137, left lower column, l. 9 to p. 144, right upper column, last line | p. 35, right lower column, l. 14 to p. 36, left upper column, 4 line up from the bottom | p. 64, ll. 1 to 51 |

TABLE 3

| Photographic Constitutional Element | JP-A-62-215272 | JP-A-2-33144 | EP-A-355660 |
|---|---|---|---|
| Dispersing Method of Photographic Additives | p. 144, left lower column, l. 1 to p. 146, right upper column, l. 7 | p. 27, right lower column, l. 10 to p. 28, left upper column, last line<br>p. 35, right lower column, l. 12 to p. 36, right upper column, l. 7 | p. 63, l. 51 to p. 64, l. 56 |
| Hardening Agent | p. 146, right upper column, l. 8 to p. 155, left lower column, l. 4 | — | — |
| Developing Agent Precursor | p. 155, left lower column, l. 5 to p. 155, right lower column, l. 2 | — | — |
| DIR Compound | p. 155, right lower column, l. 3 to 9 | — | — |
| Support | p. 155, right lower column, l. 19 to p. 156, left upper column, l. 14 | p. 38, right upper column, l. 18 to p. 39, left upper column, l. 3 | p. 66, l. 29 to p. 67, l. 13 |
| Layer Constitution of Photographic Materiai | p. 156, left upper column, l. 15 to p. 156, right lower column, l. 14 | p. 28, right upper column, ll. 1 to 15 | p. 45, ll. 41 to 52 |
| Dye | p. 156, right lower column, l. 15 to p. 184, right column, last line | p. 38, left upper column, l. 12 to right upper column, l. 7 | p. 66, ll. 18 to 22 |
| Color Mixing Preventive | p. 185, left upper column, l. 1 to p. 188, right lower column, l. 3 | p. 36, right upper column, ll. 8 to 11 | p. 64, l. 57 to p. 65, l. 1 |
| Gradation Controlling Agent | p. 188, right lower column, ll. 4 .to 8 | — | — |

TABLE 4

| Photographic Constitutional Element | JP-A-62-215272 | JP-A-2-33144 | EP-A-355660 |
|---|---|---|---|
| Antistaining Agent | p. 188, right lower column, l. 9 to p. 193, right lower column, l. 10 | p. 37, left upper column, last line to right lower column, l. 13 | p. 65, l. 32 to p. 66, e. 17 |
| Surfactant | p. 201, left lower column, l. 1 to p. 210, right upper column, last line | p. 18, right upper column, l. 1 to p. 24, right lower column, last line<br>p. 27, left lower column, 10 line up from the bottom to right lower column, l. 9 | — |
| Fluorine-Containinq Compound (as anti-static agent, coating aid, lubricant, adhesion preventive agent) | p. 210, left lower column, l. 1 to p. 222, left lower column, l. 5 | p. 25, left upper column, l. 1 to p. 27, right lower column, l. 9 | — |
| Binder (hydrophilic colloid) | p. 222, left lower column, l. 6 to p. 225, left upper column, last line | p. 38, right upper column, ll. 8 to 18 | p. 66, ll. 23 to 28 |
| Thickener | p. 225, right upper column, l. 1 to p. 227, right upper column, l. 2 | — | — |
| Antistatic Agent | p. 227, right upper column, e. 3 to p. 230, left upper column, l. 1 | — | — |

60

TABLE 5

| Photographic Constitutional Element | JP-A-62-215272 | JP-A-2-33144 | EP-A-355660 |
|---|---|---|---|
| Polymer Latex | p. 230, left upper column, l. 2 to p. 239, last line | — | — |
| Matting Agent | p. 240, left upper column, l. 1 to p. 240, right upper column, last line | — | — |
| Photographic Processing Method (processing step and additives) | p. 3, right upper column, l. 7 to p. 10, right upper column, l. 5 | p. 39, left upper column, l. 4 to p. 42, left upper column, last line | p. 67, l. 14 to p. 69, l. 28 |

Note) References in JP-A-62-215272 include contents amended by The Amendment dated March 16, 1987, which appears at the end of the Patent Publication.
Further, of the above-described couplers, short wave type yellow couplers as disclosed in JP-A-63-231451, JP-A-63-123047, JP-A-63-241547, JP-A-1-173499, JP-A-1-213648 and JP-A-1-250944 are preferably used as yellow couplers. Also, it is preferred to use cycloalkane series acylacetanilide type yellow couplers as disclosed in JP-A-4-116643 and indoline series acetanilide type yellow couplers as disclosed in Japanese Patent Application No. 2-286341.

It is preferred that cyan, magenta or yellow couplers are impregnated with a loadable latex polymer (e.g., disclosed in U.S. Pat. No. 4,203,716) in the presence (or absence) of the high boiling point organic solvents disclosed in the above table, or the couplers are dissolved in a polymer insoluble in water but soluble in an organic solvent and then dispersed in a hydrophilic colloidal aqueous solution in an emulsified state. Examples of polymers insoluble in water but soluble in an organic solvent which can preferably be used in the present invention include homopolymers or copolymers disclosed in U.S. Pat. No. 4,857,449, from columns 7 to 15, and WO 88/00723, pp. 12 to 30. Methacrylate based or acrylamide based polymers are preferred, in particular, acrylamide based polymers are preferred in view of dye stability.

In the photographic material according to the present invention, it is preferred to use color image preservability improving compounds disclosed in EP-A-277589 in combination with the couplers. In particular, the use in combination with pyrazoloazole couplers, pyrrolotriazole couplers, and acylacetamide yellow couplers is preferred.

That is, the use of the compound disclosed in the above EP Patent which produces a chemically inactive and substantially colorless compound upon chemically bonding with the aromatic amine developing agent remaining after color development processing and/or the compound disclosed in the above EP Patent which produces a chemically inactive and substantially colorless compound upon chemically bonding with the oxidized product of the aromatic amine color developing agent remaining after color development processing, alone or in combination, is preferred for preventing the generation of stain due to the formation of a colored dye caused by the coupling reaction of the coupler with the color developing agent or the oxidized product thereof remaining in the film, or preventing other side reactions, during preservation after processing.

Examples of preferred cyan couplers for use in the present invention include diphenylimidazole based cyan couplers disclosed in JP-A-2-33144, 3-hydroxypyridine based cyan couplers disclosed in EP-A-333185, cyclic active methylene based cyan couplers disclosed in JP-A-64-32260, pyrrolopyrazole type cyan couplers disclosed in EP-A-456226, pyrroloimidazole type cyan couplers disclosed in EP 484909, and pyrrolotriazole type cyan couplers disclosed in EP 488248 and EP-A-491197. The use of pyrrolotriazole type cyan couplers disclosed in JP-A-9-189988 is particularly preferred.

Examples of magenta couplers which can be used in the present invention include 5-pyrazolone based magenta couplers disclosed in the well-known literature in the above table. 5-Pyrazolone based magenta couplers, in which arylthio is released, disclosed in WO 92/18901, WO 92/18902 and WO 92/18903 are preferred as a 5-pyrazolone based magenta coupler in that image preservability is stable and fluctuation of the image quality due to processing is less.

Well-known pyrazoloazole based couplers are used in the present invention, and in view of hue, image stability and color-forming ability, the pyrazoloazole couplers to which a secondary or tertiary alkyl group is directly bonded at the 2-, 3- or 6-position of the pyrazoloazole ring disclosed in JP-A-61-65245, the pyrazoloazole couplers which contain a sulfonamido group in the molecule disclosed in JP-A-61-65246, the pyrazoloazole couplers which have an alkoxyphenylsulfonamide ballast group disclosed in JP-A-61-147254, and the pyrazoloazole couplers which have an alkoxyl group or an aryloxy group at the 6-position disclosed in EP-A-226849 and EP-A-294785, are preferably used.

Well-known acylacetanilide type couplers are preferably used and, above all, pivaloylacetanilide type couplers which have a halogen atom or an alkoxyl group at the ortho-position of the anilide ring, the acylacetanilide type couplers the acyl group of which is substituted with a cycloalkanecarbonyl group at the 1-position disclosed in EP-A-447969, JP-A-5-107701 and JP-A-5-113642, the malondianilide type coupler disclosed in EP-A-482552 and EP-A-524540, and the indolyl based yellow couplers disclosed in JP-A-5-11416 and JP-A-5-307250, are preferably used.

The color photographic material of the present invention comprises a support having coated thereon at least one yellow color-forming silver halide emulsion layer, at least one magenta color-forming silver halide emulsion layer, and at least one cyan color-forming silver halide emulsion layer. In a color photographic paper for general use, color reproduction can be effected according to the subtractive color process by incorporating into silver halide emulsion layers color couplers capable of forming dyes having a complementary color relationship to light to which the corresponding silver halide emulsion is sensitized. In a typical color photographic paper, silver halide emulsion grains are spectrally sensitized in the above described order of the color-forming layers by blue-sensitive, green-sensitive, and red-sensitive spectral sensitizing dyes and coated on a support in the above described order. However, the coating may be effected by different orders. That is, there are cases where the light-sensitive layer containing the silver halide grains having the largest average grain size is preferred to be uppermost layer from the viewpoint of rapid processing or where the magenta color-forming light-sensitive layer is preferred to be undermost layer considering the storage stability under light irradiation.

With respect to the processing method of the photographic material of the present invention, in addition to the methods disclosed in the above table, processing materials and processing methods disclosed in JP-A-2-207250, from page 26, right lower column, line 1 to page 34, right upper column, line 9, and JP-A-4-97355, from page 5, left upper column, line 17 to page 18, right lower column, line 20 are also preferably used. A developing method of using an activator such as an alkali solution not containing a developing agent with a developing agent being incorporated in a photographic material is also a preferred method.

As a wet developing method of a photographic material, methods of using a usual developing solution or an activator can be used. In particular, since a color developing agent is not contained in a processing solution in an activator processing system, a processing solution can be taken charge of and handled easily, further, the load of waste solution disposal is less, therefore, it is a preferred method from the standpoint of the environmental protection.

In an activator processing system, a photographic material having incorporated therein a color developing agent or a precursor thereof is used and photographic materials containing a hydrazine type compound as a color developing agent as disclosed in JP-A-8-234388, JP-A-9-152686, JP-A-9-152693, JP-A-9-160193 and JP-A-9-211814 are preferably used. Further, a method in which a low silver content photographic material is image-amplified (intensification processing) using hydrogen peroxide is also preferably used, e.g., an image-forming method using an activator containing hydrogen peroxide as disclosed in JP-A-8-297354 and JP-A-9-152695 is preferred.

A photographic material is ordinarily subjected to desilvering processing after activator processing, but as desilvering processing is not required in the image amplifying processing using a low silver content photographic material, simple processing such as washing or stabilization is preferably effected after activator processing. Further, in a system of reading out image information of a photographing material using a scanner, a processing mode which necessitates no desilvering processing is feasible even when a high silver content photographic material is used.

The materials of the processing solutions such as an activator solution, a desilvering solution, a washing solution and a stabilizing solution for use in the present invention and processing methods are disclosed in detail in JP-A-8-234388 and *Research Disclosure*, Item 36544, pp. 536 to 541 (September, 1994).

In the photographic material of the present invention, not only exposure through a color negative film but also scanning exposure can preferably be used.

In scanning exposure, the light modulated from visible light based on the image information using a semiconductor laser as a light source is used. If visible light cannot be obtained by using a semiconductor laser alone, a second harmonic generating element (an SHG element) comprising a nonlinear optical crystal is used in combination with a semiconductor laser.

The diameter of optical beam of scanning exposure is 150 μm or less, preferably from 10 to 120 μm, and more preferably from 20 to 100 μm. The diameter of optical beam means the diameter of the marginal part where the strength of the cross section vertical to the optical beam lowering to $1/e^2$ (e is a base of natural logarithm) of the strength on the central axis.

The shape of optical beam in scanning exposure is not particularly restricted but substantially a circle is preferred. In this case, "substantially" means that the ratio of the diameter in the subsidiary scanning direction to the diameter in the main scanning direction falls within the range of from 97% to 103%.

The effective beam diameter of optical beam in scanning exposure can be obtained according to absolutely the same method as the description on page 4, left lower column in JP-A-5-19423. That is, one line segment of a photographic material is exposed using a laser beam of output of 50% of the laser beam strength sufficient to give maximum color density of the image to be formed, and is color development processed, thereby a linear colored image is obtained. The density profile of this linear colored image is measured in the vertical direction to the line segment using a microdensitometer. Line width of density D1/5 corresponding to ⅕ of the maximum colored density Dmax of this profile is taken as the effective beam diameter.

The effective beam diameter in scanning exposure is 300 μm or less, but is preferably from 10 to 240 μm, and more preferably from 20 to 200 μm.

The scanning pitch in scanning exposure is defined by the interstices of raster (locus of optical beam), and when optical beam is a circle, the scanning pitch is expressed by the interstices of the center of the beam. Effective beam diameter is preferably larger than image scanning pitch. Specifically, overlapping width of raster, image scanning pitch and effective beam diameter satisfy the following equation:

$$L=d-p$$

L: overlapping width, d: effective beam diameter, p: scanning pitch

Among the range satisfying the above equation, scanning pitch is preferably from 0.25 to 190 μm and most preferably from 2 to 80 μm.

The overlapping width of raster is not particularly restricted but is within the range of from 5% to 95%, preferably from 15% to 85%, and more preferably from 20% to 80%, for preventing unevenness of image and unevenness of color.

Optical beam scanning in scanning exposure can be effected by a drum scanning system, but a system in which main scanning is performed by subjecting optical beam to incidence at a polygonal mirror rotating at a high speed and subsidiary scanning is performed by transporting a photographic material in the direction vertical to the optical beam is preferred. The number of faces of a polygonal mirror is not particularly restricted but is preferably from 2 to 36, particularly preferably from 6 to 14. Stable rotation number of a polygonal mirror is preferably from 4,000 to 36,000 rpm. The number of scanning lines per hour can be obtained by multiplying a rotation number by the face number of a mirror.

The exposing time per one pixel in scanning exposure is $10^{-4}$ seconds or less, preferably $10^{-6}$ seconds or less, with the pixel density being 400 dpi.

The present invention will be described in detail below with referring to examples.

EXAMPLE 1

Preparation of {100} High Silver Chloride Regular Crystal Grains

Four point eight (4.8) grams of sodium chloride and 30 g of inactivated gelatin were added to 1 liter of water, and 18 mol of an aqueous solution of silver nitrate (silver nitrate: 1.08 g) and 18 ml of an aqueous solution of sodium chloride (sodium chloride: 0.389 g) were added by a double jet method over 3 minutes, with stirring, to the vessel maintained at 33° C. Ten minutes after the completion of the addition, 270 ml of an aqueous solution of silver nitrate (silver nitrate: 16.2 g) and 270 ml of an aqueous solution of sodium chloride (sodium chloride: 5.832 g) were added thereto over 18 minutes. Further, 3 minutes after the completion of the addition, 595 ml of silver nitrate (silver nitrate: 119 g) and 595 ml of sodium chloride (sodium chloride: 43.0 g) were added thereto over 41 minutes.

The temperature of the reaction vessel was increased to 60° C. during the succeeding 41 minutes.

Subsequently, 170 ml of an aqueous solution of silver nitrate (silver nitrate: 34 g) and 170 ml of an aqueous solution of sodium chloride (containing 7.88 g of sodium chloride, amount shown in Table 6 of potassium iodide, $1.5\times10^{-8}$ mol of potassium ferrocyanide and $1.5\times10^{-8}$ mol of iridium hexachloride) were added thereto.

After the completion of the addition, $4.0\times10^{-3}$ mol per mol of the silver of potassium thiocyanate was added at 60° C. and then the temperature was raised to 75° C. and followed by stirring further 10 minutes.

The temperature was reduced to 40° C., and then the desalting process was carried out by the ordinary flocculation method.

After desalting, 78 g of gelatin, 80 ml of phenol (5%) and 199 ml of distilled water were added to the reaction system. By using sodium hydroxide and silver nitrate solution, pH and pAg were adjusted to 6.2 and 7.5, respectively.

Thus, Emulsions 101 to 108 containing high silver chloride grains having an average equivalent-sphere diameter of 0.62 $\mu$m were obtained.

TABLE 6

| Emulsion No. | Shape of Grains | Iodide Content of Outermost Layer (%) | Sensitizing Dye | Remarks |
|---|---|---|---|---|
| 101 | Cubic | None | 1 | Comparison |
| 102 | " | " | 2 | " |
| 103 | " | 2.0 | 1 | " |
| 104 | " | 2.0 | 2 | " |
| 105 | " | None | 3 | " |
| 106 | " | " | 4 | " |
| 107 | " | 2.0 | 3 | " |
| 108 | " | 2.0 | 4 | " |
| 109 | Tabular | None | 1 | " |
| 110 | " | " | 2 | Invention |
| 111 | " | 0.5 | 1 | Comparison |
| 112 | " | 0.5 | 2 | Invention |
| 113 | " | 2.0 | 1 | Comparison |
| 114 | " | 2.0 | 2 | Invention |
| 115 | " | 4.0 | 1 | Comparison |
| 116 | " | 4.0 | 2 | Invention |
| 117 | " | 8.0 | 1 | Comparison |
| 118 | " | 8.0 | 2 | Invention |
| 119 | " | None | 3 | Comparison |
| 120 | " | " | 4 | Invention |
| 121 | " | 2.0 | 3 | Comparison |
| 122 | " | 2.0 | 4 | Invention |

Preparation of {111} High silver Chloride Tabular Grains

Two point zero (2.0) grams of sodium chloride and 2.4 g of inactivated gelatin were added to 1.2 liters of water, and 60 ml of an aqueous solution of silver nitrate (silver nitrate: 9 g) and 60 ml of an aqueous solution of sodium chloride (sodium chloride: 3.2 g) were added by a double jet method over 1 minute, with stirring, to the vessel maintained at 33° C. One minute after the completion of the addition, 1 mmol of Crystal Phase Controller 1 was added to the reaction vessel. After the elapse of further one minute, 3.0 g of sodium chloride was added thereto. The temperature of the reaction vessel was increased to 60° C. during the succeeding 25 minutes. Physical ripening was carried out for 16 minutes while maintaining the temperature at 60° C., then 290 g of a 10% aqueous solution of phthalated gelatin and 0.8 mmol of Crystal Phase Controller 1 were added thereto. Subsequently, 754 ml of an aqueous solution of silver nitrate (silver nitrate: 113 g) and 768 ml of an aqueous solution of sodium chloride (sodium chloride: 41.3 g) were added at an accelerated flow rate over 28 minutes. During the last 7 minutes of 28 minutes, i.e., from 21 minutes after the beginning of addition of aqueous solutions of silver nitrate and sodium chloride until 28 minutes, 30 ml of a 0.25 M sodium chloride aqueous solution containing 0.48 g of potassium iodide (shown in Table 6), 11 mg of yellow prussiate of potash (i.e., potassium ferrocyanide) and $1.5\times10^{-8}$ mol of iridium hexachloride was added to the reaction solution.

Crystal Phase Controller 1

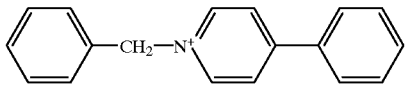

After completion of addition, 27 ml of 1% potassium thiocyanate and the sensitizing dye shown in Table 6 in an amount of $6.0\times10^{-4}$ mol per mol of the silver were added to the reaction solution, and then the temperature was raised to 75° C. and followed by stirring further 10 minutes.

Sensitizing Dye 1

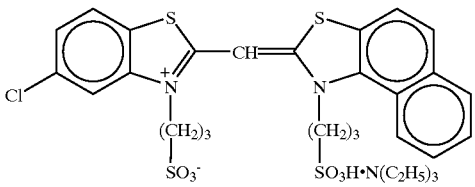

Sensitizing Dye 2

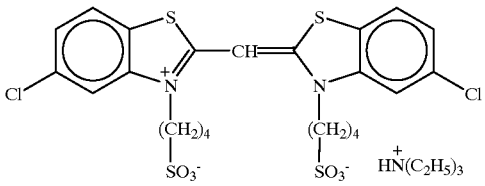

Sensitizing Dye 3

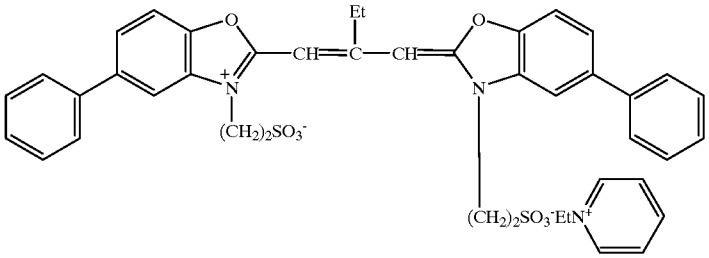

Sensitizing Dye 4

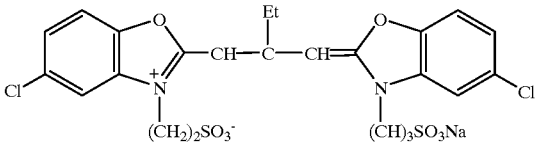

The temperature was reduced to 40° C., and then the desalting process was carried out using Precipitant 1 by the ordinary flocculation method.

Precipitant 1

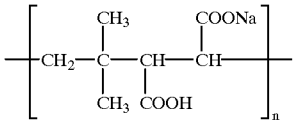

Average molecular weight: 120,000

After desalting, 67 g of gelatin, 80 ml of phenol (5%) and 150 ml of distilled water were added to the reaction system. By using sodium hydroxide and a silver nitrate solution, pH was adjusted to 6.2 and pAg to 7.5. The thus-obtained emulsions (i.e., Emulsions 109 to 122) were emulsions in which 96% of the total projected area of the entire silver halide grains in the emulsions were occupied by tabular grains (having an aspect ratio of 2 or more), and the tabular grains had an average equivalent-sphere diameter of 0.65 μm, an average equivalent-circle diameter of 1.19 μm, an average thickness of 0.13 μm, and an average aspect ratio of 9.1.

Chemical Sensitization

Emulsions 101 to 122 shown in Table 6 were maintained at 60° C. and optimally chemically sensitized using sodium thiosulfonate, 1-(5-methylureidophenyl)-5-mercaptotetrazole, Selenium Compound 1, sodium thiosulfate and chloroauric acid. Thus, chemically sensitized Emulsions 101 to 122 were obtained.

Selenium Compound-1

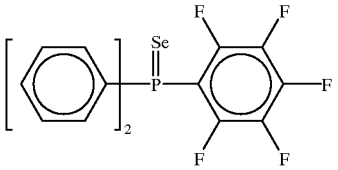

Preparation of Coated Sample

The surface of a paper support laminated on both sides with a polyethylene resin was corona discharged. The support was provided with an undercoat layer containing sodium dodecylbenzenesulfonate, and further, from the first layer to the seventh layer were succeedingly coated to obtain silver halide Color Photographic Material Samples T101 to T122 having the following layer constitution. The coating solution of each photographic constituting layer was prepared as follows.

Preparation of Coating Solution

Couplers, dye image stabilizers and UV absorbers were dissolved in a solvent and ethyl acetate. This solution was emulsified dispersed in a 10 wt % gelatin aqueous solution containing a surfactant by means of a high speed stirring emulsifier (dissolver) to prepare an emulsified dispersion with addition of water. This emulsified dispersion was mixed with a high silver chloride emulsion and dissolved, and the coating solution was prepared so as to have the composition shown below.

As a gelatin hardening agent of each layer, 1-oxy-3,5-dichloro-s-triazine sodium salt was used. Further, Ab-1, Ab-2 and Ab-3 were added to each layer in each the coating amount of 15.0 mg/m$^2$, 60.0 mg/m$^2$ and 5.0 mg/m$^2$.

(Ab-1) Preservative

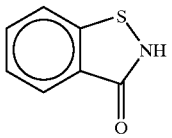

(Ab-2) Preservative

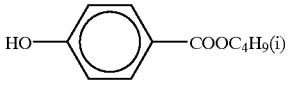

(Ab-3) Preservative

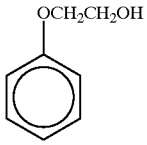

High silver chloride emulsions used in each photosensitive emulsion layer are as follows.

Emulsions shown in Table 7 were used in a blue-sensitive emulsion layer and a green-sensitive emulsion layer.

Red-Sensitive Emulsion Layer

Silver chlorobromide emulsion (cubic, a mixture in a ratio of 1/4 (silver mol ratio) of a large grain size emulsion A having an average grain size of 0.50 μm, and a small grain size emulsion B having an average grain size of 0.41 μm; variation coefficients of the grain size distribution were 0.09 and 0.11, respectively, both of them contained 0.8 mol % of silver bromide localized at a part of the grain surface, and the remaining substrate being comprising silver chloride). Sensitizing Dyes G and H shown below were added respectively in an amount of $6.0\times10^{-5}$ mol per mol of the silver halide to the large grain size emulsion A, and $9.0\times10^{-5}$ mol per mol of the silver halide to the small grain size emulsion B.

TABLE 7

| Coated Sample No. | Emulsion: Blue-sensitive Emulsion Layer | Emulsion: Green-sensitive Emulsion Layer | Remarks |
|---|---|---|---|
| T101 | 101 | 105 | Comparison |
| T102 | 102 | 105 | " |
| T103 | 103 | 105 | " |
| T104 | 104 | 105 | " |
| T105 | 101 | 105 | Comparison (same as in T101) |
| T106 | 101 | 106 | Comparison |
| T107 | 101 | 107 | " |
| T108 | 101 | 108 | " |
| T109 | 109 | 105 | " |
| T110 | 110 | 105 | Invention |
| T111 | 111 | 105 | Comparison |
| T112 | 112 | 105 | Invention |
| T113 | 113 | 105 | Comparison |
| T114 | 114 | 105 | Invention |
| T115 | 115 | 105 | Comparison |
| T116 | 116 | 105 | Invention |
| T117 | 117 | 105 | Comparison |
| T118 | 118 | 105 | Invention |
| T119 | 101 | 119 | Comparison |
| T120 | 101 | 120 | Invention |
| T121 | 101 | 121 | Comparison |
| T122 | 101 | 122 | Invention |

Sensitizing Dye G

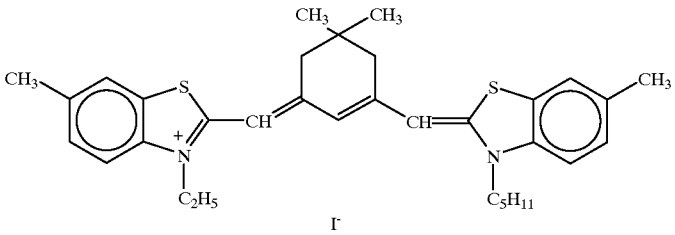

Sensitizing Dye H

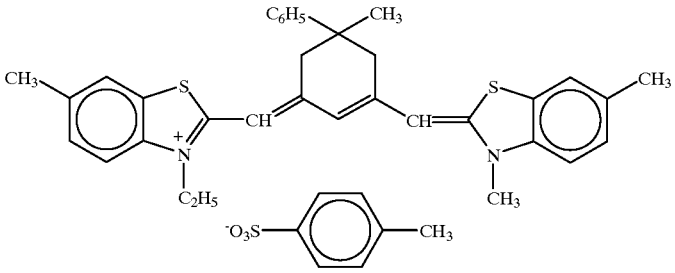

Further, the following Compound I was added in an amount of $2.6\times10^{-3}$ mol per mol of the silver halide.

Compound I

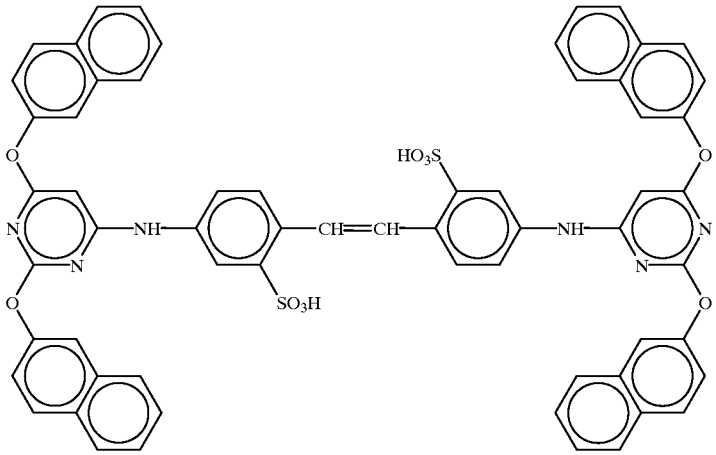

Further, 1-(3-methylureidophenyl)-5-mercaptotetrazole was added to the blue-sensitive emulsion layer, the green-sensitive emulsion layer and the red-sensitive emulsion layer in an amount of $3.3\times10^{-4}$ mol, $1.0\times10^{-3}$ mol and $5.9\times10^{-4}$ mol, respectively, per mol of the silver halide.

Further, 1-(3-methylureidophenyl)-5-mercaptotetrazole was added to the second layer, the fourth layer, the sixth layer, and the seventh layer in an amount of 0.2 mg/m$^2$, 0.2 mg/m$^2$, 0.6 mg/m$^2$, and 0.1 mg/m$^2$, respectively.

Further, 0.05 g/m$^2$ of a copolymer of methacrylic acid and butyl acrylate (weight ratio: 1/1, average molecular weight of from 200,000 to 400,000) was added to the red-sensitive emulsion layer.

Further, catechol-3,5-disodium disulfonate was added to the second layer, the fourth layer, and the sixth layer in an amount of 6 mg/m$^2$, 6 mg/m$^2$, and 18 mg/m$^2$, respectively.

Moreover, the following dyes were added to emulsion layers for preventing irradiation (the numerals in parentheses represent respective coating amounts).

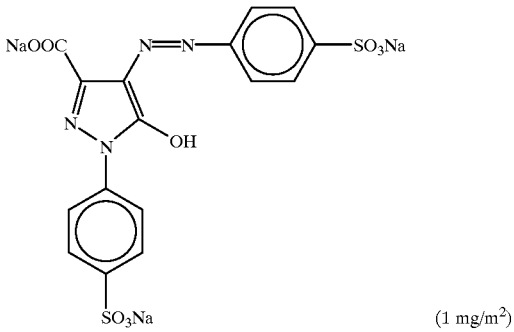

(1 mg/m$^2$)

(5 mg/m$^2$)

-continued

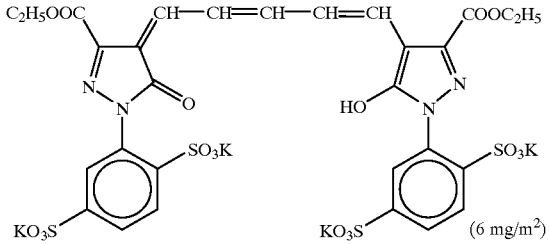

(6 mg/m$^2$)

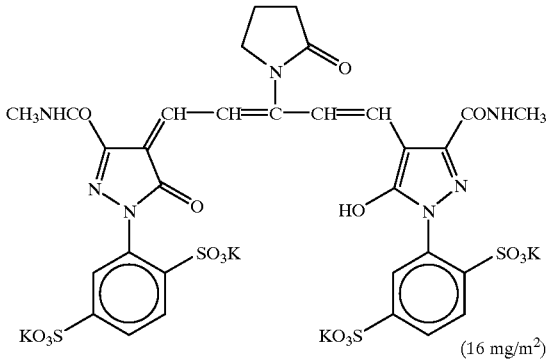

(16 mg/m$^2$)

Layer Constitution

The constitution of each layer is described below. The numeral represents the coating amount (g/m$^2$). The numeral for the silver halide emulsion represents the coating amount in terms of silver.

Support:

Polyethylene resin-laminated paper (a white pigment ($TiO_2$, content: 16 wt %, ZnO, content: 4 wt %), a fluorescent brightening agent (4,4'-bis(5-methylbenzoxazolyl) stilbene, 13 mg/m$^2$) and a bluish dye (ultramarine) were added to the -polyethylene resin of the first layer side).

| | |
|---|---|
| First Layer (blue-sensitive emulsion layer) | |
| Emulsion | 0.26 |
| Gelatin | 1.20 |
| Yellow Coupler (ExY) | 0.62 |
| Dye Image Stabilizer (Cpd-1) | 0.08 |
| Dye Image Stabilizer (Cpd-2) | 0.04 |
| Dye Image Stabilizer (Cpd-3) | 0.08 |
| Solvent (Solv-1) | 0.20 |
| Second Layer (color mixture preventing layer) | |
| Gelatin | 0.58 |
| Color Mixing Preventive (Cpd-4) | 0.10 |
| Dye Image Stabilizer (Cpd-5) | 0.018 |
| Dye Image Stabilizer (Cpd-6) | 0.02 |
| Dye Image Stabilizer (Cpd-7) | 0.01 |
| Solvent (Solv-1) | 0.01 |
| Solvent (Solv-2) | 0.09 |
| Third Layer (green-sensitive emulsion layer) | |
| Emulsion | 0.26 |
| Gelatin | 0.85 |
| Magenta Coupler (ExM) | 0.30 |
| UV Absorber (UV-1) | 0.01 |
| UV Absorber (UV-2) | 0.01 |
| UV Absorber (UV-3) | 0.01 |
| UV Absorber (UV-4) | 0.01 |
| Dye Image Stabilizer (Cpd-2) | 0.02 |
| Dye Image Stabilizer (Cpd-4) | 0.002 |
| Dye Image Stabilizer (Cpd-6) | 0.01 |
| Dye Image Stabilizer (Cpd-7) | 0.01 |
| Dye Image Stabilizer (Cpd-8) | 0.04 |
| Dye Image Stabilizer (Cpd-9) | 0.03 |
| Dye Image Stabilizer (Cpd-10) | 0.01 |
| Dye Image Stabilizer (Cpd-11) | 0.0001 |
| Solvent (Solv-3) | 0.07 |
| Solvent (Solv-4) | 0.07 |
| Solvent (Solv-5) | 0.22 |
| Fourth Layer (color mixture preventing layer) | |
| Gelatin | 0.58 |
| Color Mixing Preventive (Cpd-4) | 0.10 |
| Color Mixing Preventive (Cpd-5) | 0.018 |
| Color Mixing Preventive (Cpd-6) | 0.02 |
| Color Mixing Preventive (Cpd-7) | 0.01 |
| Solvent (Solv-1) | 0.01 |
| Solvent (Solv-2) | 0.09 |
| Fifth Layer (red-sensitive emulsion layer) | |
| Emulsion | 0.12 |
| Gelatin | 0.72 |
| Cyan Coupler (ExC-1) | 0.13 |
| Cyan Coupler (ExC-2) | 0.03 |
| Dye Image Stabilizer (Cpd-6) | 0.01 |
| Dye Image Stabilizer (Cpd-7) | 0.02 |
| Dye Image Stabilizer (Cpd-9) | 0.04 |
| Dye Image Stabilizer (Cpd-10) | 0.01 |
| Dye Image Stabilizer (Cpd-14) | 0.10 |
| Dye Image Stabilizer (Cpd-15) | 0.02 |
| Dye Image Stabilizer (Cpd-16) | 0.02 |
| Dye Image Stabilizer (Cpd-17) | 0.02 |
| Dye Image Stabilizer (Cpd-18) | 0.02 |
| Solvent (Solv-5) | 0.17 |
| Solvent (Solv-6) | 0.02 |
| Solvent (Solv-8) | 0.01 |
| Solvent (Solv-9) | 0.01 |
| Sixth Layer (UV absorbing layer) | |
| Gelatin | 0.55 |
| UV Absorber (UV-1) | 0.19 |
| UV Absorber (UV-2) | 0.06 |
| UV Absorber (UV-3) | 0.06 |
| UV Absorber (UV-4) | 0.05 |
| UV Absorber (UV-5) | 0.09 |
| Solvent (Solv-7) | 0.20 |
| Seventh Layer (Protective layer) | |
| Gelatin | 0.50 |
| Acryl-Modified Copolymer of Polyvinyl Alcohol (modification degree: 17%) | 0.02 |

-continued
| | |
|---|---|
| Liquid Paraffin | 0.02 |
| Surfactant (Cpd-13) | 0.01 |
(ExY) Yellow Coupler
60/40 mixture of
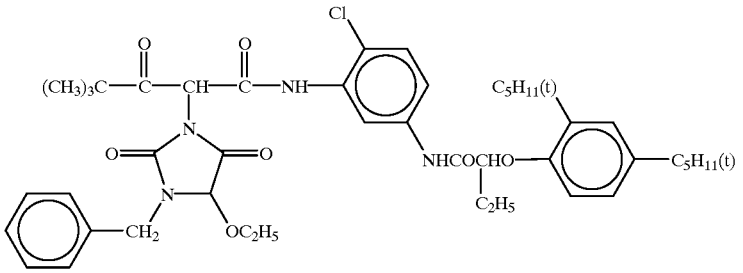
and
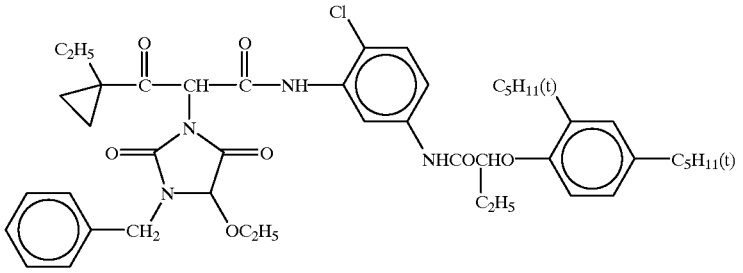
(ExM) Magenta Coupler
60/40 mixture of
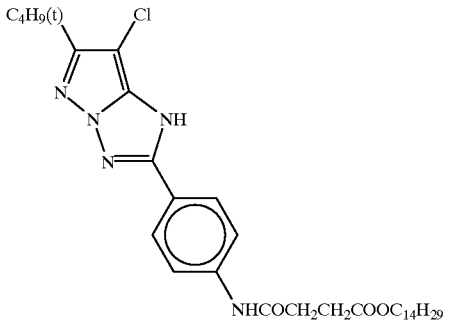
and
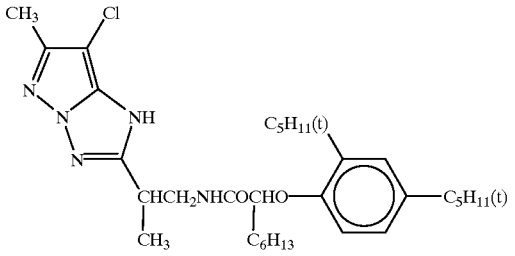
(ExC-1) Cyan Coupler -continued
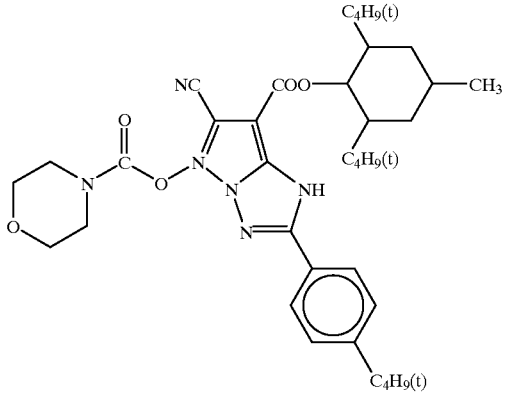
(ExC-2) Cyan Coupler
50/25/25 mixture of
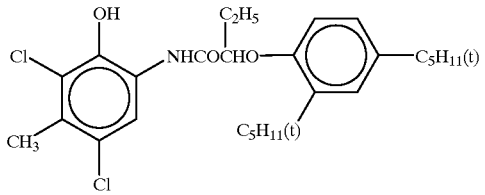
and
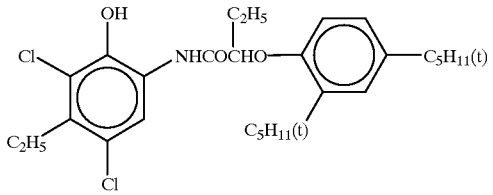
and
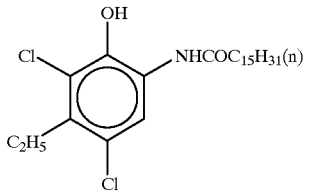
(Cpd-1) Dye Image Stabilizer
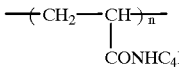
number average molecular weight: about 60,000
(Cpd-2) Dye Image Stabilizer
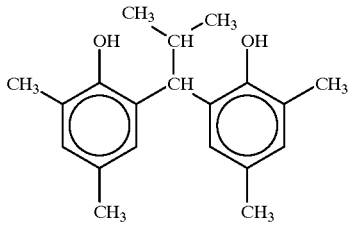

-continued
(Cpd-3) Dye Image Stabilizer
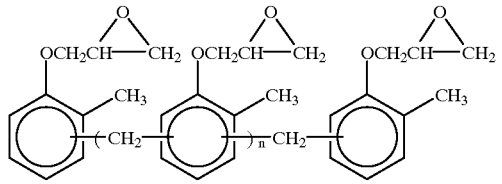
n = 7–8 (average value)
(Cpd-4) Color Mixing Preventive
1/1/1 mixture of
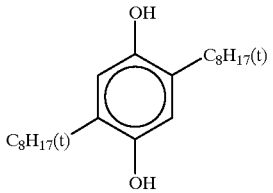
and
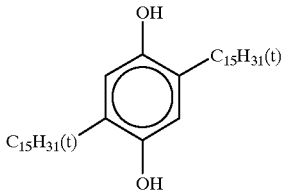
and
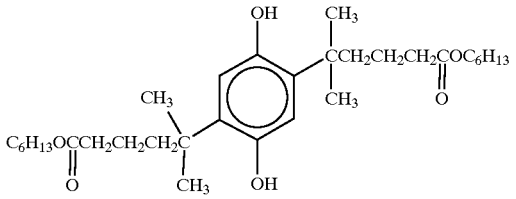
(Cpd-5) Auxiliary Color Mixing Preventive
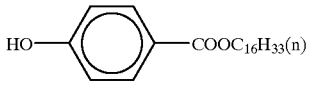
(Cpd-6) Stabilizer
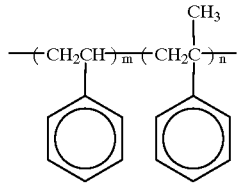
number average molecular weight: 600
m/n = 10/90
(Cpd-7) Color Mixing Preventive -continued
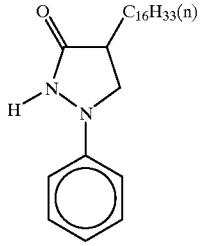
(Cpd-8) Dye Image Stabilizer
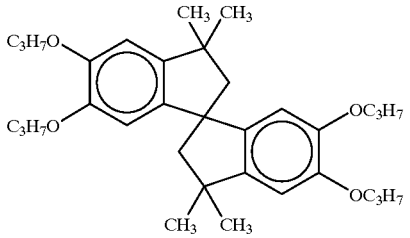
(Cpd-9) Dye Image Stabilizer
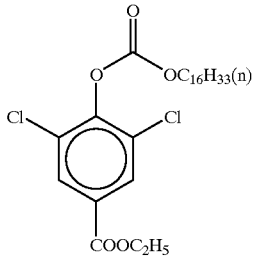
(Cpd-10) Dye Image Stabilizer
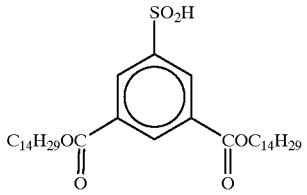
(Cpd-11)
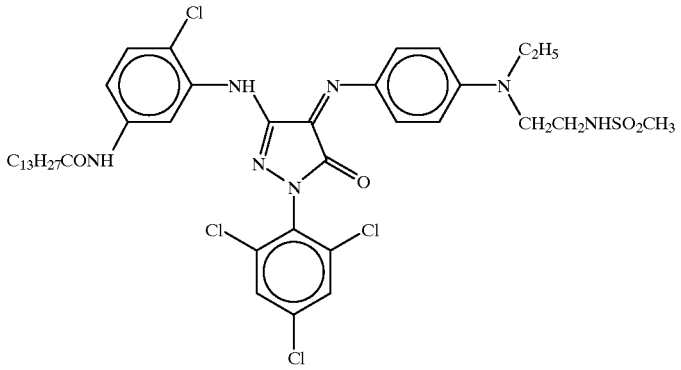
(Cpd-13) Surfactant
7/3 mixture of -continued
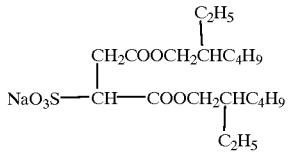
and
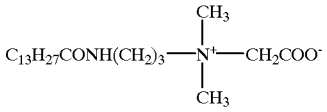
(Cpd-14)
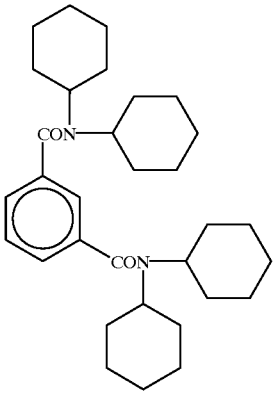
(Cpd-15)
1/1 mixture of
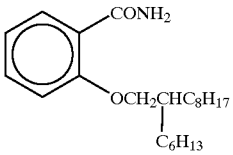
and
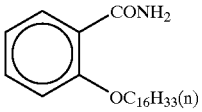
(Cpd-16)
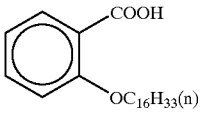
(Cpd-17)

-continued
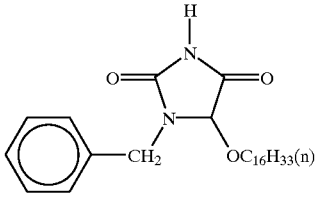
(Cpd-18)
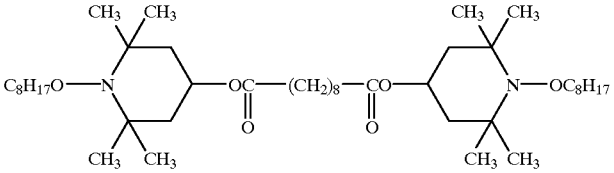
(UV-1) UV Absorber
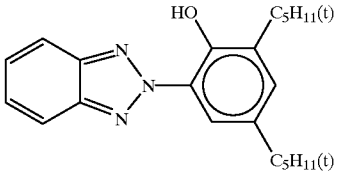
(UV-2) UV Absorber
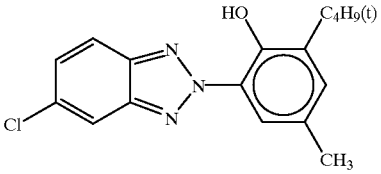
(UV-3) UV Absorber
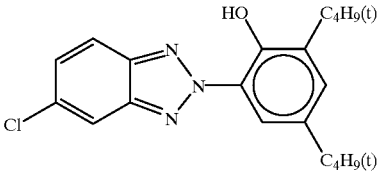
(UV-4) UV Absorber
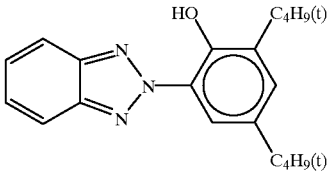
(UV-5) UV Absorber
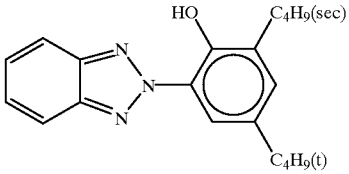

-continued
(Solv-1) Solvent
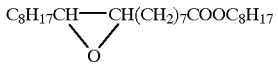
(Solv-2) Solvent
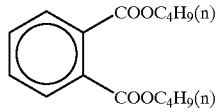
(Solv-3) Solvent
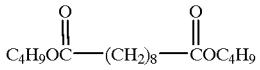
(Solv-4) Solvent
$O{=}P{-}(OC_6H_{13}(n))_3$
(Solv-5) Solvent
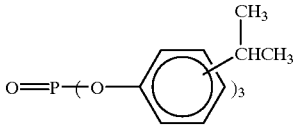
(Solv-6) Solvent
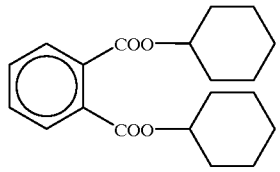
(Solv-7) Solvent
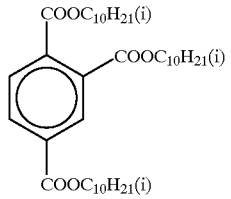
(Solv-8) Solvent
(Solv-8)
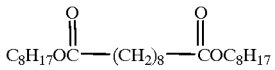
(Solv-9) Solvent
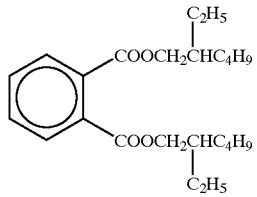

Thus, Coated Samples T101 to T122 were prepared as described above.

Exposure

Exposure of gradation of three color separation was performed with laser beams of three colors of B, G and R using the following exposing apparatus. At that time, laser output was corrected so as to obtain optimal improvement with each sample.

Exposing Apparatus

Three types of laser beams were used as light sources, that is, the wavelength of YAG solid (state) laser (oscillation wavelength: 946 nm) using a semiconductor laser GaAlAs (oscillation wavelength: 808.5 nm) as an excitation light source converted with SHG crystal of $LiNbO_3$ having a reversal domain structure to 473 nm, the wavelength of $YVO_4$ solid (state) laser (oscillation wavelength: 1,064 nm) using a semiconductor laser GaAlAs (oscillation wavelength: 808.5 nm) as an excitation light source converted with SHG crystal of $LiNbO_3$ having a reversal domain structure to 532 nm, and AlGaInP (oscillation wavelength: 680 nm, manufactured by Matsushita Electric Co., Ltd., Type No. LN9R20). Intensities of respective three color laser beams were modulated by AOM and could successively scanning expose a color photographic paper transferring vertically to scanning direction by polygonal mirror. For restraining the fluctuation of light amount due to changes of temperature, the temperature of semiconductor laser was maintained constant using Peltier element. Scanning exposure was conducted at 600 dpi. Optical beam diameters of B, G and R measured using an optical beam diameter measuring apparatus (118OGP manufactured by Beam Scan Co. (USA)) were 65 $\mu$m, respectively (difference between the diameter in the main scanning direction/the diameter in the subsidiary scanning direction was within 1% and beam diameter was circular). (development processing, dry to dry: 70 seconds)

The above-exposed samples were subjected to color development processing using the following processing step and processing solutions.

| Step | Processing Temperature (° C.) | Processing Time (sec) | Replenishment Rate* (ml) | Tank Capacity (liter) |
|---|---|---|---|---|
| Color Development | 40 | 15 | 35 | 2 |
| Blixing | 40 | 15 | 38 | 1 |
| Rinsing (1) | 40 | 10 | — | 1 |
| Rinsing (2) | 40 | 10 | — | 1 |
| Rinsing (3) | 40 | 10 | 90 | 1 |
| Drying | 80 | 10 | — | 1 |

Rinsing was conducted in a 3-tank countercurrent system from rinsing (3) to rinsing (1).

Replenishing rate per $m^2$ of the photographic material

In the above process, water of rinsing (3) tank was force fed to a reverse osmosis membrane, the penetrated water was charged to rinsing (3) tank, and concentrated water not passed the reverse osmosis membrane was fed back to rinsing (2) tank and used. For saving the crossover time, blades were installed connecting each rinsing tank and samples were passed therebetween. A spraying apparatus as disclosed in JP-A-8-314088 was installed in each step and a circulating processing solution was sprayed to samples at spraying rate a-per one tank of from 4 to 6 liters/minute.

The composition of each processing solution was as follows.

| Color Developing Solution | Tank Solution | Replenisher |
|---|---|---|
| Water | 700 ml | 700 ml |
| Sodium Triisopropylnaphthalene(β)sulfonate | 0.1 g | 0.1 g |
| Ethylenediaminetetraacetic Acid | 3.0 g | 3.0 g |
| Disodium 1,2-dihydroxybenzene-4,6-disulfonate | 0.5 g | 0.5 g |
| Triethanolamine | 12.0 g | 12.0 g |
| Potassium Chloride | 15.8 g | |
| Potassium Bromide | 0.04 g | |
| Potassium Carbonate | 27.0 g | 27.0 g |
| Sodium Sulfite | 0.1 g | 0.1 g |
| Disodium-N,N-bis(sulfonatoethyl)hydroxylamine | 18.0 g | 18.0 g |
| N-Ethyl-N-(β-methanesulfonamidoethyl)-3-methyl-4-aminoaniline Sulfate | 8.0 g | 23.0 g |
| Sodium-bis(2,4-disulfonatoethyl-1,3,5-triazyl-6)-diaminostilbene-2,2'-disulfonate | 5.0 g | 6.0 g |
| Water to make | 1,000 ml | 1,000 ml |
| pH (25° C.) | 10.35 | 12.80 |

The blixing solution was prepared by mixing replenishers of two components as follows.

| Blixing Solution | Tank Solution | Replenishing amount (total 38 ml per $m^2$) |
|---|---|---|
| First Replenisher | 260 ml | 18 ml |
| Second Replenisher | 290 ml | 20 ml |
| Water to make | 1,000 ml | |
| pH (25° C.) | 5.0 | |

The compositions of the first and second replenishers are as follows.

First Replenisher

| | |
|---|---|
| Water | 150 ml |
| Ethylenebisguanidine Nitrate | 30 g |
| Ammonium Sulfite Monohydrate | 226 g |
| Ethylenediaminetetraacetic Acid | 7.5 g |
| Brightening Agent (SR-1) | 1.0 g |
| Ammonium Bromide | 30 g |
| Ammonium Thiosulfate (700 g/liter) | 340 ml |
| Water to make | 1,000 ml |
| pH (25° C.) | 5.82 |

SR-1

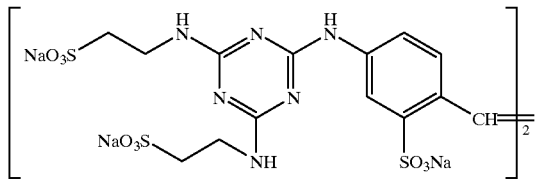

Second Replenisher

| | |
|---|---|
| Water | 140 ml |
| Ethylenediaminetetraacetic Acid | 11.0 g |
| Ammonium Ethylenediaminetetraacetato Ferrate (III) | 384 g |
| Acetic Acid (50%) | 230 ml |

-continued

| | |
|---|---|
| Water to make | 1,000 ml |
| pH (25° C.) | 3.35 |

Rinsing Solution

Ion Exchange Water (Ca, Mg: each 3 ppm or less)

Comparative Processing

CP45-X processing (dry to dry: 180 seconds) manufactured by Fuji Photo Film Co., Ltd. was conducted for comparison.

The reflection density of the processed colored sample was measured using densitometer, model TCD, manufactured by Fuji Photo Film Co., Ltd. Sensitivity was expressed by the exposure amount required to give color density of fog density plus 1.0. In the blue-sensitive layer, the sensitivity of Sample T101 processed for 180 seconds was taken as 100 and expressed in relative value, and in the green-sensitive layer, the sensitivity of Sample T105 processed for 180 seconds was taken as 100 and expressed in relative value. The results obtained are shown in Table 8.

Thus, the high sensitivity and low fog are realized by using the surface iodide type tabular grains according to the present invention.

EXAMPLE 2

Preparation of {111} High Silver Chloride Grains formed with Other Crystal Phase Controller Two point zero (2.0) grams of sodium chloride and 2.4 g of inactivated gelatin were added to 1.2 liters of water, and 60 ml of an aqueous solution of silver nitrate (silver nitrate: 9 g) and 60 ml of an aqueous solution of sodium chloride (sodium chloride: 3.2 g) were added by a double jet method over 1 minute, with stirring, to the vessel maintained at 33° C. One minute after the completion of the addition, 1.44 mmol of Crystal Phase Controller 2 was added to the reaction vessel. After the elapse of further one minute, 3.0 g of sodium chloride was added thereto. The temperature of the reaction vessel was increased to 60° C. during the succeeding 25 minutes. Physical ripening was carried out for 16 minutes while maintaining the temperature at 60° C., then 290 g of a 10% aqueous solution of phthalated gelatin and 1.0 mmol of Crystal Phase Controller 2 were added thereto.

TABLE 8

| Coated Sample | Processing for 180 Seconds | | | | Processing for 70 Seconds (Invention) | | | | |
|---|---|---|---|---|---|---|---|---|---|
| | Blue-Sensitive Layer | | Green-Sensitive Layer | | Blue-Sensitive Layer | | Green-Sensitive Layer | | |
| No. | Fog | Sensitivity | Fog | Sensitivity | Fog | Sensitivity | Fog | Sensitivity | Remarks |
| T101 | 0.03 | 100 | | | 0.06 | 105 | | | Comparison |
| T102 | 0.03 | 110 | | | 0.04 | 110 | | | " |
| T103 | 0.03 | 175 | | | 0.08 | 180 | | | " |
| T104 | 0.03 | 170 | | | 0.06 | 180 | | | " |
| T105 | | | 0.07 | 100 | | | 0.11 | 105 | " |
| T106 | | | 0.07 | 105 | | | 0.08 | 116 | " |
| T107 | | | 0.08 | 175 | | | 0.13 | 180 | " |
| T108 | | | 0.07 | 170 | | | 0.09 | 183 | " |
| T109 | 0.03 | 165 | | | 0.05 | 179 | | | " |
| T110 | 0.02 | 181 | | | 0.03 | 188 | | | Invention |
| T111 | 0.03 | 213 | | | 0.06 | 215 | | | Comparison |
| T112 | 0.02 | 215 | | | 0.03 | 218 | | | Invention |
| T113 | 0.03 | 240 | | | 0.07 | 270 | | | Comparison |
| T114 | 0.03 | 256 | | | 0.03 | 280 | | | Invention |
| T115 | 0.03 | 245 | | | 0.07 | 245 | | | Comparison |
| T116 | 0.03 | 260 | | | 0.04 | 265 | | | Invention |
| T117 | 0.05 | 230 | | | 0.08 | 230 | | | Comparison |
| T118 | 0.05 | 210 | | | 0.06 | 205 | | | Invention |
| T119 | | | 0.07 | 158 | | | 0.10 | 164 | Comparison |
| T120 | | | 0.07 | 158 | | | 0.07 | 165 | Invention |
| T121 | | | 0.07 | 245 | | | 0.12 | 270 | Comparison |
| T122 | | | 0.07 | 246 | | | 0.08 | 284 | Invention |

As is apparent from the results in Table 8, with the emulsion according to the present invention, the increase in fog density was not observed, which is often generated due to rapid processing, and showed low fog density. The increase in fog density brought about by rapid processing has been a large obstacle particularly in the emulsion using iodide on the grain surface, but a low fog emulsion can be obtained even in a surface iodide type emulsion according to the present invention.

Particularly, it is seen that the remarkable effect can be obtained at 1 mol % or more of the surface iodide content in which the increase in fog is large in the rapid processing, provided that the decrease in sensitivity and reduction of the fog-inhibiting effect are observed.

The above effects are remarkable in the {111} tabular grains as compared with the {100} grains.

Subsequently, 754 ml of an aqueous solution of silver nitrate (silver nitrate: 113 g) and 768 ml of an aqueous solution of sodium chloride (sodium chloride: 41.3 g) were added at an accelerated flow rate over 28 minutes. During the last 7 minutes of 28 minutes, i.e., from 21 minutes after the beginning of addition of aqueous solutions of silver nitrate and sodium chloride until 28 minutes, 30 ml of a 0.25 M sodium chloride aqueous solution containing 0.48 g of potassium iodide (shown in Table 9), 11 mg of yellow prussiate of potash (i.e., potassium ferrocyanide) and $1.5\times10^{-8}$ mol of iridium hexachloride was added to the reaction solution.

Crystal Phase Controller 2

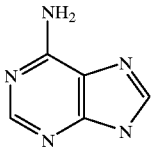

After completion of addition, 27 ml of 1% potassium thiocyanate and the sensitizing dye shown in Table 9 in an amount of $6.0\times10^{-4}$ mol per mol of the silver were added to the reaction solution, and then pH was adjusted to 2.5 using sulfuric acid, and the temperature was raised to 75° C. and followed by stirring for 20 minutes.

This emulsion was washed in the same manner as in Example 1. After washing, 67 g of gelatin, 80 ml of phenol (5%) and 150 ml of distilled water were added to the reaction system. By using sodium hydroxide and a silver nitrate solution, pH was adjusted to 6.2 and pAg to 7.5. Thus-obtained high silver chloride grain emulsions (i.e., Emulsions 201 to 208) were emulsions in which 96% of the total projected area of the entire silver halide grains in the emulsions were occupied by tabular grains, and the tabular grains had an average equivalent-sphere diameter of 0.64 μm, an average equivalent-circle diameter of 1.16 μm, an average thickness of 0.13 μm and an average aspect ratio of 8.9.

TABLE 9

| Emulsion No. | Shape of Grains | Iodide Content of Outermost Layer (%) | Sensitizing Dye | Remarks |
|---|---|---|---|---|
| 201 | Tabular | None | 1 | Comparison |
| 202 | " | " | 2 | Invention |
| 203 | " | 2.0 | 1 | Comparison |
| 204 | " | 2.0 | 2 | Invention |
| 205 | " | None | 3 | Comparison |
| 206 | " | " | 4 | Invention |
| 207 | " | 2.0 | 3 | Comparison |
| 208 | " | 2.0 | 4 | Invention |

Emulsions 201 and 208 were chemically sensitized and coated in the same manner as in Example 1.

The blue-sensitive layer and the green-sensitive layer used in the coating were shown in Table 10.

The red-sensitive layer was prepared using the same emulsion as in Example 1.

Thus, chemically sensitized Emulsions T201 to T208 were obtained.

TABLE 10

| Coated Sample No. | Emulsion: Blue-sensitive Emulsion Layer | Emulsion: Green-sensitive Emulsion Layer | Remarks |
|---|---|---|---|
| T201 | 201 | 105 | Comparison |
| T202 | 202 | 105 | Invention |
| T203 | 203 | 105 | Comparison |
| T204 | 204 | 105 | Invention |
| T205 | 101 | 205 | Comparison |
| T206 | 101 | 206 | Invention |
| T207 | 101 | 207 | Comparison |
| T208 | 101 | 208 | Invention |

The thus-obtained Coated Samples T201 to T208 and T101 to T108 were exposed for 1/10 second using a filter in which a tungsten lamp, a yellow filter, a magenta filter and a cyan filter are combined and a wedge, and then the exposed samples were processed for 180 seconds and 70 seconds at the dry to dry, respectively, in the same manner as in Example 1.

The reflection density of the processed colored sample was measured using densitometer, model TCD, manufactured by Fuji Photo Film Co., Ltd. Sensitivity was expressed by the exposure amount required to give color density of fog density plus 1.0. In the blue-sensitive layer, the sensitivity of Sample T109 processed for 180 seconds was taken as 100 and expressed in relative value, and in the green-sensitive layer, the sensitivity of Sample T119 processed for 180 seconds was taken as 100 and expressed in relative value. The results obtained are shown in Table 11.

TABLE 11

| Coated Sample | Processing for 180 Seconds: Blue-Sensitive Layer | | Processing for 180 Seconds: Green-Sensitive Layer | | Processing for 70 Seconds (Invention): Blue-Sensitive Layer | | Processing for 70 Seconds (Invention): Green-Sensitive Layer | | |
|---|---|---|---|---|---|---|---|---|---|
| No. | Fog | Sensitivity | Fog | Sensitivity | Fog | Sensitivity | Fog | Sensitivity | Remarks |
| T101 | 0.03 | 100 | | | 0.06 | 105 | | | Comparison |
| T102 | 0.03 | 120 | | | 0.04 | 120 | | | " |
| T103 | 0.03 | 175 | | | 0.08 | 180 | | | " |
| T104 | 0.03 | 205 | | | 0.06 | 208 | | | " |
| T105 | | | 0.07 | 100 | | | 0.11 | 105 | " |
| T106 | | | 0.07 | 116 | | | 0.08 | 116 | " |
| T107 | | | 0.08 | 171 | | | 0.13 | 174 | " |
| T108 | | | 0.07 | 190 | | | 0.10 | 193 | " |
| T201 | 0.03 | 123 | | | 0.06 | 125 | | | " |
| T202 | 0.03 | 143 | | | 0.04 | 140 | | | Invention |
| T203 | 0.04 | 188 | | | 0.08 | 190 | | | Comparison |
| T204 | 0.04 | 215 | | | 0.04 | 221 | | | Invention |
| T205 | | | 0.07 | 112 | | | 0.11 | 115 | Comparison |
| T206 | | | 0.07 | 122 | | | 0.08 | 126 | Invention |
| T207 | | | 0.08 | 185 | | | 0.13 | 193 | Comparison |
| T208 | | | 0.07 | 206 | | | 0.09 | 220 | Invention |

As is apparent from the results of Table 11, the effect of the present invention was observed even if the crystal phase controller was changed, particularly the effect of the present invention was remarkable when a pyridinium salt-crystal phase controller was used (see Table 8).

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having thereon at least one light-sensitive silver halide emulsion layer, wherein at least 80% of the entire projected area of the silver halide grains contained in said silver halide emulsion layer are occupied by tabular silver halide grains having an aspect ratio of 2 or more and main planes of {111} faces, said silver halide grains comprise at least 80 mol % of silver chloride, and said tabular silver halide grains are aspectrally sensitized with the dye represented by formula (S);

(S)

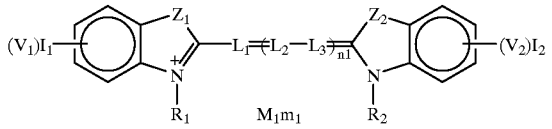

wherein $Z_1$ and $Z_2$ each represents a sulfur atom, a selenium atom, an oxygen atom or a nitrogen atom; and $V_1$ and $V_2$ each represents a monovalent substituent, provided that $V_1$ and $V_2$ each does not represent an aromatic group and adjacent two or more groups represented by $V_1$ or $V_2$ are not bonded to each other to form a condensed ring; $I_1$ and $I_2$ each represents 0, 1, 2, 3 or 4; $L_1$, $L_2$ and $L_3$ each represents a methine group; $R_1$ and $R_2$ each represents an alkyl group; $n_1$ represents 0, 1 or 2; $m_1$ represents a number of 0 or more necessary to neutralize the charge of the molecule; and $M_1$ represents a charge balancing counter ion.

2. The silver halide photographic material as claimed in claim 1, wherein said silver halide grains comprise the tabular grains containing at least 0.1 mol % of silver iodide based on all the silver amount in the total tabular grains and having the outermost layer containing 1 to 6 mol % of silver iodide.

3. The silver halide photographic material as claimed in claim 1, wherein said tabular silver halide grains are formed in the presence of at least one compound selected from the compounds represented by formulae (I), (II) and (III);

(I)

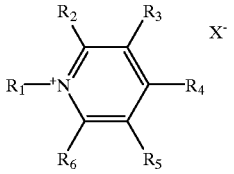

wherein $R_1$ represents an alkyl group, an alkenyl group, or an aralkyl group; $R_2$, $R_3$, $R_4$, $R_5$ and $R_6$ each represents a hydrogen atom or a substituent group, $R_2$ and $R_3$, $R_3$ and $R_4$, $R_4$ and $R_5$, and $R_5$ and $R_6$ may be condensed to form a ring, provided that at least one of $R_2$, $R_3$, $R_4$, $R_5$ and $R_6$ represents an aryl group; and $X^-$ represents a counter anion;

(II)

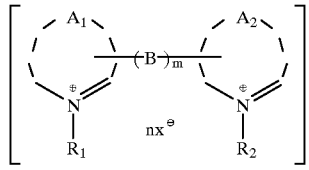

(III)

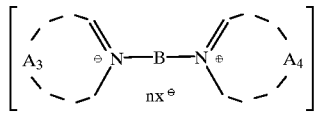

wherein $A_1$, $A_2$, $A_3$ and $A_4$, which may be the same or different, each represents a nonmetallic atomic group necessary for completing a nitrogen-containing heterocyclic ring; B represents a divalent linking group; m represents 0 or 1; $R_1$ and $R_2$ each represents an alkyl group; X represents an anion; and n represents 0 or 1, and n represents 0 when inner salt is formed.

4. The silver halide photographic material as claimed in claim 1, wherein said silver halide grains comprise at least 95 mol % of silver chloride.

5. The silver halide photographic material as claimed in claim 1, wherein said silver halide grains are core/shell type grains, the core part comprises 90% or more of silver chloride, the shell part has a higher iodide content than the core part, and the shell part has an iodide content of from 1 to 6 mol %.

6. The silver halide photographic material as claimed in claim 1, wherein said tabular silver halide grains have an aspect ratio of from 3 to 20.

7. The silver halide photographic material as claimed in claim 1, wherein said tabular silver halide grains have a dispersion coefficient of equivalent-circle diameter of from 5 to 20%.

8. The silver halide photographic material as claimed in claim 1, wherein $V_1$ and $V_2$ each represents a fluorine atom or a chlorine atom, and $R_1$ and $R_2$ each represents a carboxyl group, a sulfoalkyl group or an unsubstituted alkyl group.

9. The silver halide photographic material as claimed in claim 1, wherein said silver halide grains contain the metal ions or complex ions of at least one metals selected from the group consisting of osmium, iridium, rhodium, platinum, ruthenium, palladium, cobalt, nickel and iron.

10. An image-forming method which comprises image-wise exposing and development processing a silver halide photographic material comprising a support having thereon at least one light-sensitive silver halide emulsion, wherein said silver halide photographic material is processed in a total processing time of 75 seconds or less, and said silver halide photographic material is a light-sensitive material, wherein at least 80% of the entire projected area of the silver halide rains contained in said silver halide emulsion layer are occupied by tabular silver halide grains having an aspect ratio of 2 or more and main planes of {111} faces, said silver halide grains comprise at least 80 mol % of silver chloride, and said tabular silver halide grains are spectrally sensitized with the dye represented by formula (S);

(S)

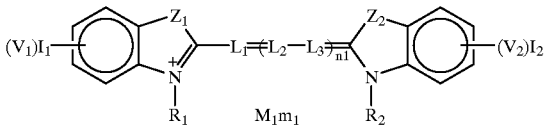

wherein $Z_1$ and $Z_2$ each represents a sulfur atom, a selenium atom, an oxygen atom or a nitrogen atom; and $V_1$ and $V_2$ each represents a monovalent substituent, provided that $V_1$ and $V_2$ each does not represent an aromatic group and adjacent two or more groups represented by $V_1$ or $V_2$ are not bonded to each other to form a condensed ring; $I_1$ and $I_2$ each represents 0, 1, 2, 3 or 4; $L_1$, $L_2$ and $L_3$ each represents a methine group; $R_1$ and $R_2$ each represents an alkyl group; $n_1$ represents 0, 1 or 2; $m_1$ represents a number of 0 or more necessary to neutralize the charge of the molecule; and $M_1$ represents a charge balancing counter ion.

11. The image-forming method as claimed in claim 10, which comprises digital scanning exposure.

12. The image-forming method as claimed in claim 10, wherein said support is a reflective type support.

13. The image-forming method as claimed in claim 10, wherein said silver halide photographic material contains a pyrazoloazole coupler.

* * * * *